US012398934B2

(12) United States Patent
Ishiyama

(10) Patent No.: US 12,398,934 B2
(45) Date of Patent: Aug. 26, 2025

(54) REFRIGERATION CYCLE APPARATUS TO ATTAIN BOTH IMPROVEMENT IN CONTROLLABILITY FOR A FLOW RATE OF FLOWING GAS REFRIGERANT AND IMPROVEMENT IN HEAT EXCHANGE EFFICIENCY OF A HEAT EXCHANGER

(71) Applicant: Mitsubishi Electric Corporation, Tokyo (JP)

(72) Inventor: Hiroki Ishiyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 188 days.

(21) Appl. No.: 18/027,504

(22) PCT Filed: Nov. 24, 2020

(86) PCT No.: PCT/JP2020/043649
§ 371 (c)(1),
(2) Date: Mar. 21, 2023

(87) PCT Pub. No.: WO2022/113166
PCT Pub. Date: Jun. 2, 2022

(65) Prior Publication Data

US 2023/0384005 A1 Nov. 30, 2023

(51) Int. Cl.
*F25B 41/26* (2021.01)
*F25B 13/00* (2006.01)
(Continued)

(52) U.S. Cl.
CPC ..... *F25B 41/20* (2021.01); *F25B 13/00* (2013.01); *F25B 41/26* (2021.01); *F25B 41/39* (2021.01);
(Continued)

(58) Field of Classification Search
CPC ..... F25B 41/26; F25B 41/42; F25B 2313/02791; F25B 2400/051; F25B 2600/2507; F25B 2600/2519
See application file for complete search history.

(56) References Cited

U.S. PATENT DOCUMENTS 5,617,738 A 4/1997 Ikegami et al.
2006/0277932 A1* 12/2006 Otake ..... F25B 1/10 62/196.1
(Continued)

FOREIGN PATENT DOCUMENTS

CN 106766526 A 5/2017
CN 206953934 U 2/2018
(Continued)

OTHER PUBLICATIONS

Office Action dated Aug. 16, 2023 issued in corresponding Japanese Patent Application No. 2022-564852 (and English translation).
(Continued)

*Primary Examiner* — Jerry-Daryl Fletcher
*Assistant Examiner* — Daniel C Comings
(74) *Attorney, Agent, or Firm* — Posz Law Group, PLC

(57) ABSTRACT

A refrigeration cycle apparatus includes a flow path switching apparatus. In a first operation mode, the flow path switching apparatus is configured to cause a second port and a second refrigerant port of a second heat exchanger to communicate with a suction port of a compressor via a four-way valve. In a second operation mode, the flow path switching apparatus is configured to cause the second port to communicate with the second refrigerant port of the second heat exchanger without the second port and the second refrigerant port of the second heat exchanger communicating with the suction port of the compressor, and cause a discharge port of the compressor to communicate with a first
(Continued)

refrigerant port of the second heat exchanger via the four-way valve.

8 Claims, 19 Drawing Sheets

(51) Int. Cl.
*F25B 41/20* (2021.01)
*F25B 41/39* (2021.01)

(52) U.S. Cl.
CPC ..... *F25B 2313/02741* (2013.01); *F25B 2313/0292* (2013.01)

(56) References Cited

U.S. PATENT DOCUMENTS

| | | | | |
|---|---|---|---|---|
| 2019/0024951 | A1* | 1/2019 | Nishiyama | F25B 41/20 |
| 2020/0309392 | A1* | 10/2020 | Kim | F24F 1/0063 |
| 2023/0358446 | A1* | 11/2023 | Murata | F25B 41/20 |

FOREIGN PATENT DOCUMENTS

| | | | | |
|---|---|---|---|---|
| EP | 3128263 | A1 | 2/2017 | |
| JP | H08-093633 | A | 4/1996 | |
| JP | H10-38387 | A | 2/1998 | |
| JP | 2003-050061 | A | 2/2003 | |
| JP | 2017-67304 | A | 4/2017 | |
| WO | 2015/133626 | A1 | 9/2015 | |
| WO | WO-2017145219 | A1 * | 8/2017 | F25B 13/00 |

OTHER PUBLICATIONS

International Search Report of the International Searching Authority mailed Jan. 12, 2021 for the corresponding International application No. PCT/JP2020/043649 (and English translation).

* cited by examiner

<SECOND OPERATION MODE>

<SECOND OPERATION MODE>

REFRIGERATION CYCLE APPARATUS TO ATTAIN BOTH IMPROVEMENT IN CONTROLLABILITY FOR A FLOW RATE OF FLOWING GAS REFRIGERANT AND IMPROVEMENT IN HEAT EXCHANGE EFFICIENCY OF A HEAT EXCHANGER

CROSS REFERENCE TO RELATED APPLICATION

This application is a U.S. national stage application of International Patent Application No. PCT/JP2020/043649 filed on Nov. 24, 2020, the disclosure of which is incorporated herein by reference.

TECHNICAL FIELD

The present disclosure relates to a refrigeration cycle apparatus.

BACKGROUND

Conventionally, in an indoor heat exchanger of an air conditioner that can be switched between a cooling operation and a heating operation, flow of refrigerant in a cooling circuit is opposite to flow of refrigerant in a heating circuit, and in particular, the flow of the refrigerant and flow of air are parallel flows in the cooling circuit, thus resulting in decreased heat exchange efficiency, disadvantageously.

In order to solve such a problem, an air conditioning apparatus disclosed in Japanese Patent Laying-Open No. 2003-050061 (PTL 1) includes: flow path switching means for causing refrigerant to flow from a first indoor heat exchanger to a second indoor heat exchanger irrespective of an operation mode; and gas-liquid separation means having a gas bypass circuit connected to a suction side of a compressor between a first flow rate control valve and an indoor heat exchanger or an outdoor heat exchanger.

PATENT LITERATURE

PTL 1: Japanese Patent Laying-Open No. 2003-050061

In the air conditioning apparatus disclosed in Japanese Patent Laying-Open No. 2003-050061 (PTL 1), since pressure of the gas-liquid separator is determined by a degree of opening of the first flow rate control valve (expansion valve) of a main refrigerant circuit, the pressure cannot be freely changed, thus resulting in insufficient controllability for an amount of liquid refrigerant stored in the gas-liquid separator, i.e., insufficient controllability for a flow rate of flowing gas refrigerant, disadvantageously.

SUMMARY

The present disclosure has been made to solve the above-described problem and has an object to provide a refrigeration cycle apparatus to attain both improvement in controllability for a flow rate of flowing gas refrigerant and improvement in heat exchange efficiency of a heat exchanger.

The present disclosure is directed to a refrigeration cycle apparatus. The refrigeration cycle apparatus includes: a compressor; a first heat exchanger; a first decompressor; a gas-liquid separator; a second heat exchanger having a first refrigerant port and a second refrigerant port; a four-way valve configured to change a flow path in accordance with a first operation mode and a second operation mode to switch, between a first order and a second order, an order of circulation of refrigerant discharged from the compressor; and a flow path switching apparatus configured to switch a flow path to cause the refrigerant to flow into the first refrigerant port of the second heat exchanger and cause the refrigerant to flow out of the second refrigerant port of the second heat exchanger, irrespective of whether the order is the first order or the second order. The first order is an order of circulation of the refrigerant in an order of the compressor, the first heat exchanger, the first decompressor, the gas-liquid separator and the second heat exchanger. The second order is an order of circulation of the refrigerant in an order of the compressor, the second heat exchanger, the gas-liquid separator, the first decompressor, and the first heat exchanger. The gas-liquid separator includes: a discharge port configured to discharge the refrigerant in a liquid state; a first port connected to the first decompressor; and a second port into which the refrigerant flows and from which the refrigerant flows out. The refrigeration cycle apparatus further includes a second decompressor connected between the discharge port and the first refrigerant port of the second heat exchanger. The flow path switching apparatus is configured to, in the first operation mode, cause the second port and the second refrigerant port of the second heat exchanger to communicate with a suction port of the compressor via the four-way valve. The flow path switching apparatus is configured to, in the second operation mode, cause the second port to communicate with the second refrigerant port of the second heat exchanger without the second port and the second refrigerant port of the second heat exchanger communicating with the suction port of the compressor, and cause the discharge port of the compressor to communicate with the first refrigerant port of the second heat exchanger via the four-way valve.

According to the refrigeration cycle apparatus of the present disclosure, heat exchange efficiency of the heat exchanger can be improved without deteriorating the controllability for the flow rate of the flowing gas refrigerant.

DETAILED DESCRIPTION

Figure 1:
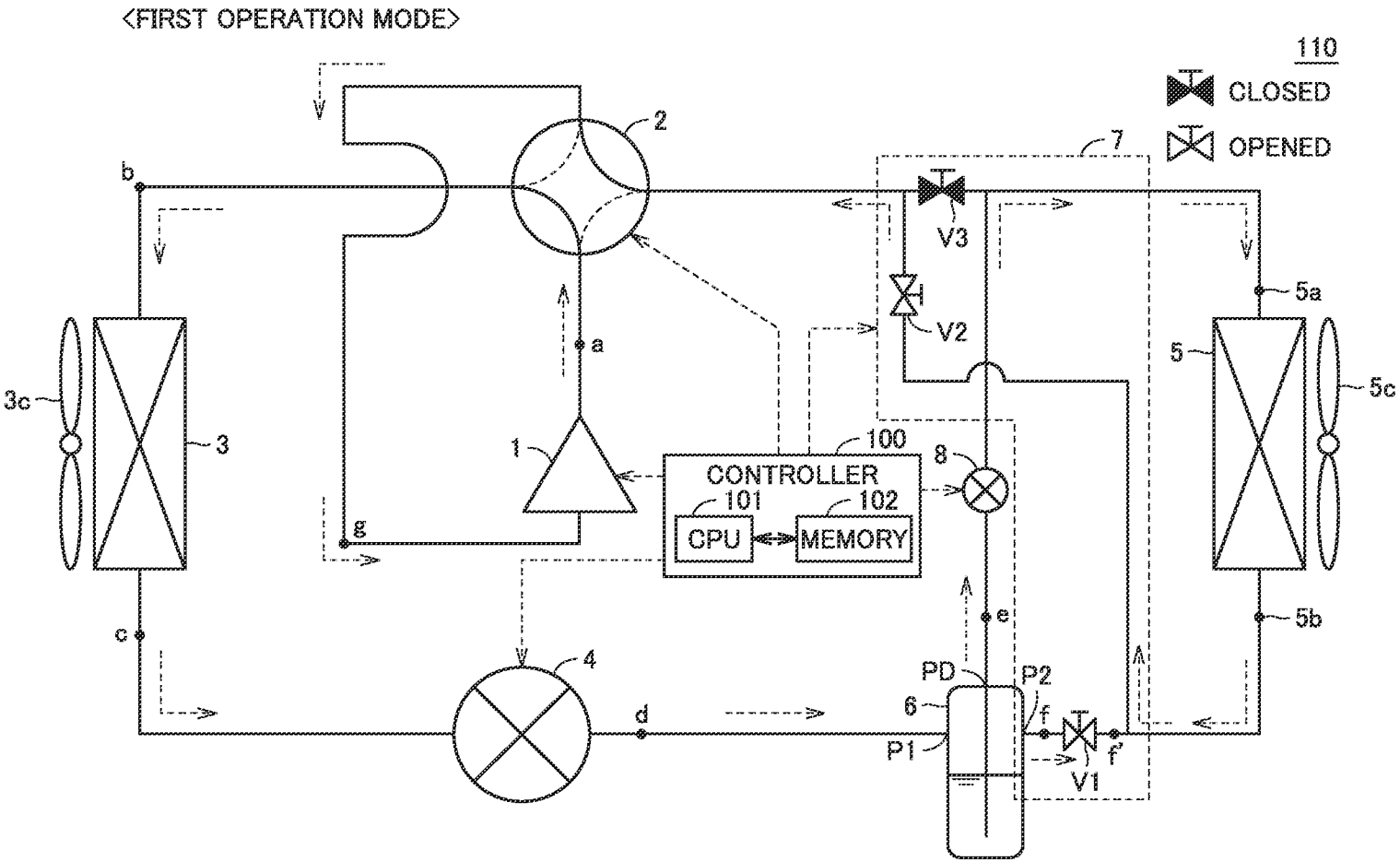
FIG. 1 is a refrigerant circuit diagram showing a configuration of a refrigeration cycle apparatus 110 according to a first embodiment.

Hereinafter, embodiments of the present disclosure will be described in detail with reference to figures. It should be noted that in the below-described figures, a relation between sizes of respective components may be different from an actual relation therebetween. In the below-described figures, components denoted by the same reference characters are the same or corresponding components, and this applies to the entire content of the specification. Further, forms of constituent elements indicated in the entire content of the specification are merely illustrative and are not limited to the descriptions thereof.

First Embodiment

In a first embodiment, the following describes a basic configuration to allow flows in a second heat exchanger 5 to be in the same direction by using a gas-liquid separator 6 and a flow path switching apparatus 7 when switching between a cooling operation and a heating operation.

FIG. 1 is a refrigerant circuit diagram showing a configuration of a refrigeration cycle apparatus 110 according to the first embodiment. Refrigeration cycle apparatus 110 shown in FIG. 1 at least includes a compressor 1, a four-way valve 2, a first heat exchanger 3, a first decompressor 4, second heat exchanger 5, gas-liquid separator 6, flow path switching apparatus 7, and a second decompressor 8.

Four-way valve 2 changes a flow path in accordance with a first operation mode and a second operation mode to switch, between a first order and a second order, an order of circulation of refrigerant discharged from compressor 1.

Flow path switching apparatus 7 is switched in accordance with whether the operation mode is the first operation mode (low-pressure operation mode) in which low-pressure refrigerant flows into second heat exchanger 5 or the second operation mode (high-pressure operation mode) in which high-pressure refrigerant flows into second heat exchanger 5.

Here, the high-pressure refrigerant is refrigerant discharged from compressor 1, and the low-pressure refrigerant is refrigerant obtained by decompressing the high-pressure refrigerant by first decompressor 4. For example, when first heat exchanger 3 is installed in an indoor unit and second heat exchanger 5 is installed in an outdoor unit, the first operation mode corresponds to the heating operation, and the second operation mode corresponds to the cooling operation.

On the other hand, when first heat exchanger 3 is installed in the outdoor unit and second heat exchanger 5 is installed in the indoor unit, the first operation mode corresponds to the cooling operation, and the second operation mode corresponds to the heating operation.

Figure 2:
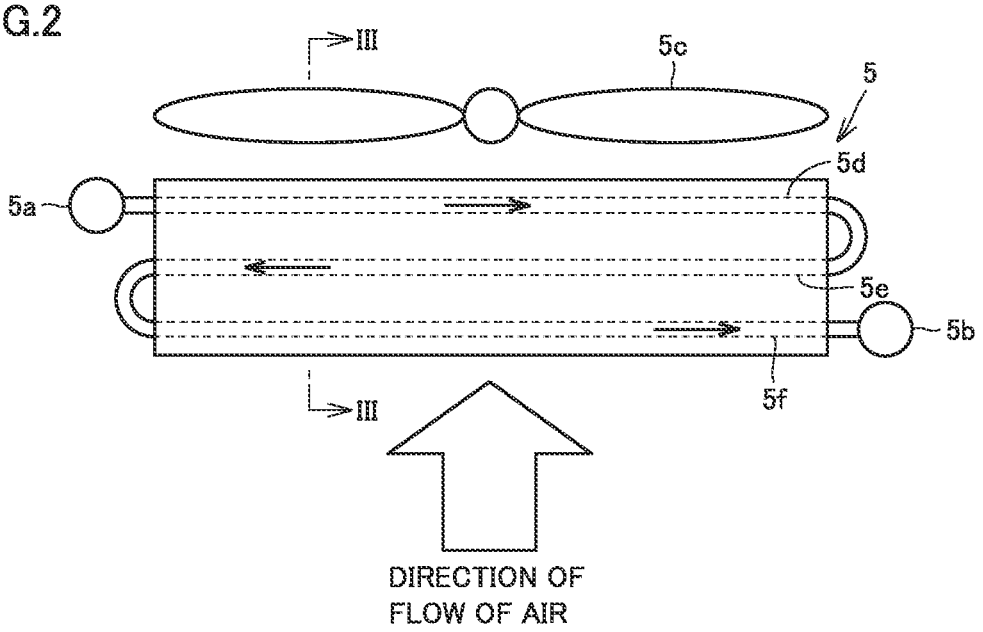
FIG. 2 is a top view showing a schematic configuration of a refrigerant path of a second heat exchanger 5.
Figure 3:
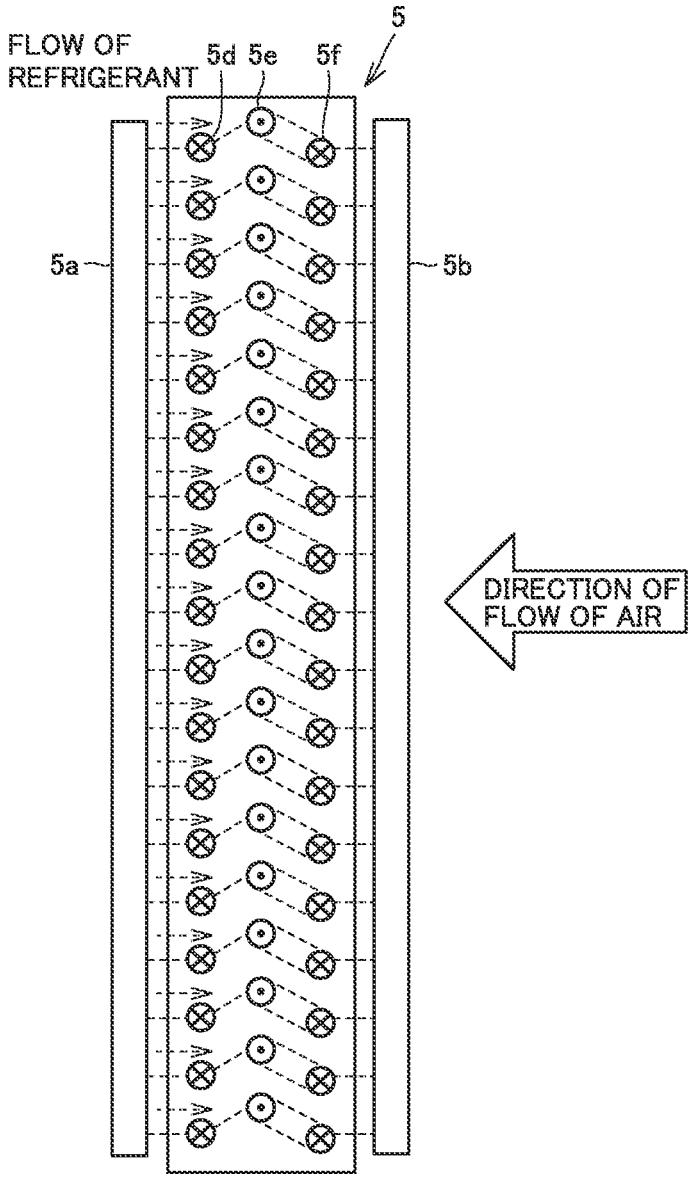
FIG. 3 is a cross sectional view showing a schematic configuration at a cross section along III-III of FIG. 2.

FIG. 2 is a top view showing a schematic configuration of a refrigerant path of second heat exchanger 5. FIG. 3 is a cross sectional view showing a schematic configuration at a cross section along III-III of FIG. 2.

Second heat exchanger 5 includes: a distributor 5*a*; a merging portion (5*b*); a fan 5*c*; and a first flow path 5*d*, a second flow path 5*e*, and a third flow path 5*f* through each of which the refrigerant flows.

Fan 5*c* is a blower apparatus that is operated to cause air to flow in the order of first flow path 5*d*, second flow path 5*e*, and third flow path 5*f* in a direction of arrow indicating a direction of flow of air. First flow path 5*d*, second flow path 5*e*, and third flow path 5*f* are arranged in the order of third flow path 5*f*, second flow path 5*e*, and first flow path 5*d* from the upstream in the flow of air. On the other hand, when attention is paid to the flow of the refrigerant, first flow path 5*d*, second flow path 5*e*, and third flow path 5*f* are arranged in the order of first flow path 5*d*, second flow path 5*e*, and third flow path 5*f* from the upstream. That is, a relation between the direction of flow of air and the direction of flow of the refrigerant is counter flows.

It has been generally known that counter flows allows for more excellent efficiency of a heat exchanger than parallel flows. Therefore, in the present embodiment, when switching the operation mode, four-way valve 2 is switched to reverse the order of flow of the refrigerant through first heat exchanger 3, first decompressor 4, and second heat exchanger 5, and connections to a first refrigerant port and a second refrigerant port of second heat exchanger 5 are changed in conjunction with the switching by using flow path switching apparatus 7. Thus, in second heat exchanger 5, the relation between the direction of flow of air and the direction of flow of the refrigerant is always counter flows.

Refrigeration cycle apparatus 110 of FIG. 1 further includes a controller 100 configured to control compressor 1, four-way valve 2, first decompressor 4, second decompressor 8, and flow path switching apparatus 7. Flow path switching apparatus 7 includes a first open/close valve V1, a second open/close valve V2, and a third open/close valve V3. As each of first decompressor 4 and second decompressor 8, an electronic expansion valve (LEV) changeable in a degree of opening in accordance with a control signal can be used, for example.

Controller 100 includes: a CPU (Central Processing Unit) 101; a memory 102 (ROM (Read Only Memory) and RAM (Random Access Memory)); an input/output buffer (not shown) for inputting/outputting various signals; and the like. CPU 101 loads each of programs stored in the ROM into the RAM or the like and executes the program. The program stored in the ROM is a program in which a processing procedure of controller 100 is written. Controller 100 controls apparatuses in refrigeration cycle apparatus 110 in accordance with these programs. This control is not limited to processing by software, and can be processing by dedicated hardware (electronic circuit).

Next, the flow of the refrigerant in the first operation mode will be described with reference to FIG. 1. In the first operation mode (low-pressure operation mode), controller 100 controls four-way valve 2 to form, in four-way valve 2, a flow path indicated by a solid line in FIG. 1. On this occasion, controller 100 opens first open/close valve V1 and second open/close valve V2, and closes third open/close valve V3.

Thus, in the first operation mode (low-pressure operation mode), the refrigerant circuit is configured to circulate the refrigerant in the order of compressor 1, four-way valve 2, first heat exchanger 3, first decompressor 4, gas-liquid separator 6, second decompressor 8, flow path switching apparatus 7, the distributor (5*a*) of second heat exchanger 5, the merging portion (5*b*) of second heat exchanger 5, flow path switching apparatus 7, four-way valve 2, and compressor 1.

Two-phase refrigerant having flowed into gas-liquid separator 6 is separated into a gas and a liquid. The refrigerant in the liquid state flows from gas-liquid separator 6 into second decompressor 8 through a port PD. The refrigerant decompressed by second decompressor 8 flows into the inlet (5*a*) of second heat exchanger 5. On the other hand, the refrigerant in the gaseous state flows from a port P2 of gas-liquid separator 6 into a portion between compressor 1 and the outlet (5*b*) of second heat exchanger 5. The refrigerant at the inlet (5*a*) of second heat exchanger 5 performs heat exchange while flowing to counter the flow of air as shown in FIGS. 2 and 3, and flows out of the outlet (5*b*) of second heat exchanger 5. The refrigerant having flowed out of the outlet (5*b*) of second heat exchanger is merged at a point f with the refrigerant in the gaseous state, passes through four-way valve 2, and is returned to compressor 1.

Figure 4:
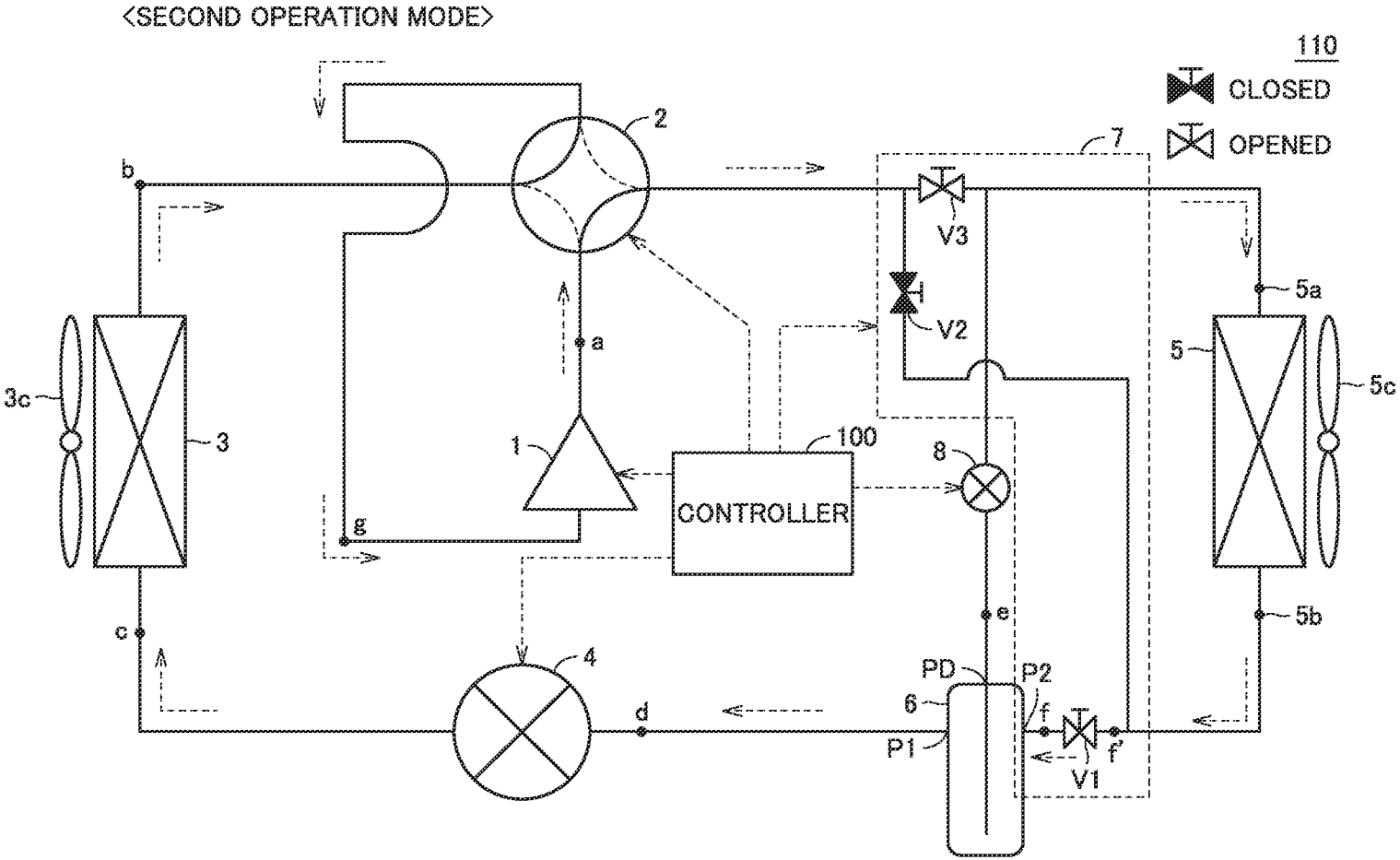
FIG. 4 is a diagram showing a flow of refrigerant in a second operation mode of refrigeration cycle apparatus 110.

FIG. 4 is a diagram showing the flow of the refrigerant in the second operation mode of refrigeration cycle apparatus 110. In the second operation mode (high-pressure operation mode), controller 100 controls four-way valve 2 to form, in four-way valve 2, a flow path indicated by a solid line in FIG. 4. On this occasion, controller 100 opens first open/close valve V1 and third open/close valve V3, and closes second open/close valve V2 and second decompressor 8.

Thus, in the second operation mode (high-pressure operation mode), the refrigerant circuit is configured to circulate the refrigerant in the order of compressor 1, four-way valve 2, flow path switching apparatus 7, the distributor (5*a*) of second heat exchanger 5, the merging portion (5*b*) of second heat exchanger 5, flow path switching apparatus 7, gas-liquid separator 6, first decompressor 4, first heat exchanger 3, four-way valve 2, and compressor 1.

Figure 5:
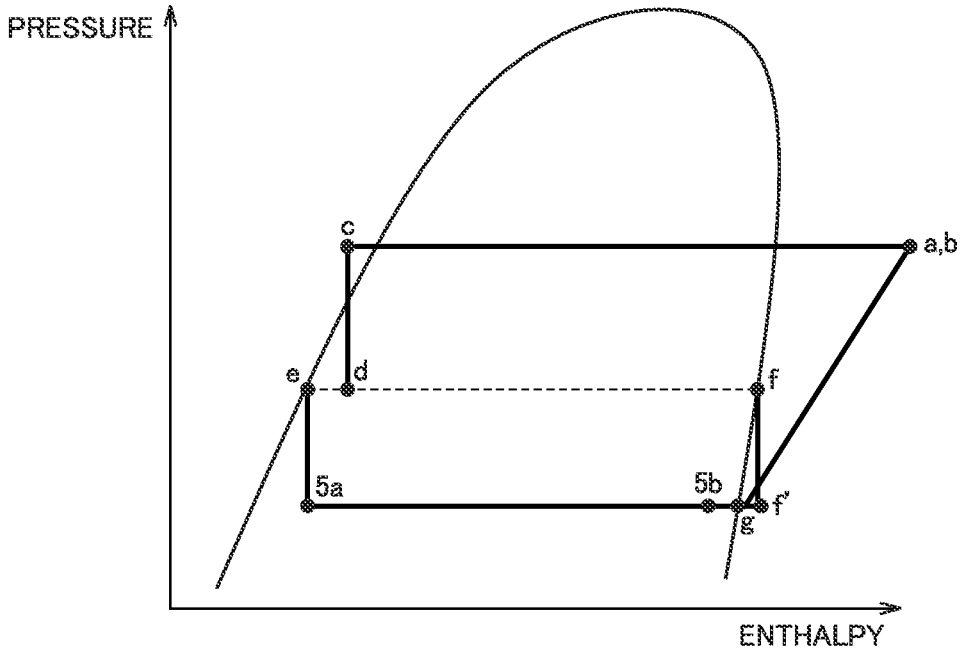
FIG. 5 is a p-h diagram showing a state change of the refrigerant in a first operation mode of refrigeration cycle apparatus 110 according to the first embodiment.

FIG. 5 is a p-h diagram showing a state change of the refrigerant in the first operation mode of refrigeration cycle apparatus 110 according to the first embodiment. Explanation will be made for FIG. 5 with reference to FIG. 1. By four-way valve 2, a point a and a point b in FIG. 1 communicate with each other. Further, by four-way valve 2 and second open/close valve V2, a point g and a point f in FIG. 1 communicate with each other.

The high-temperature and high-pressure gas refrigerant discharged from compressor 1 is condensed by first heat exchanger 3 as indicated by a line segment a, b-c in FIG. 5, is decompressed in first decompressor 4 as indicated by a line segment c-d, and flows into gas-liquid separator 6. The liquid refrigerant, separated by gas-liquid separator 6, at an intermediate pressure point e is further decompressed by second decompressor 8 as indicated by a line segment e-5*a*, and is evaporated in second heat exchanger 5 to become gas refrigerant as indicated by a line segment 5*a*-5*b*. On the other hand, the gas refrigerant, separated by gas-liquid separator 6, at an intermediate pressure point f is decompressed in first open/close valve V1 as indicated by a line segment f-f, is then merged with the gas refrigerant at a point 5*b*, passes through open/close valve V2 and four-way valve 2, and is suctioned into compressor 1 (point g).

Figure 6:
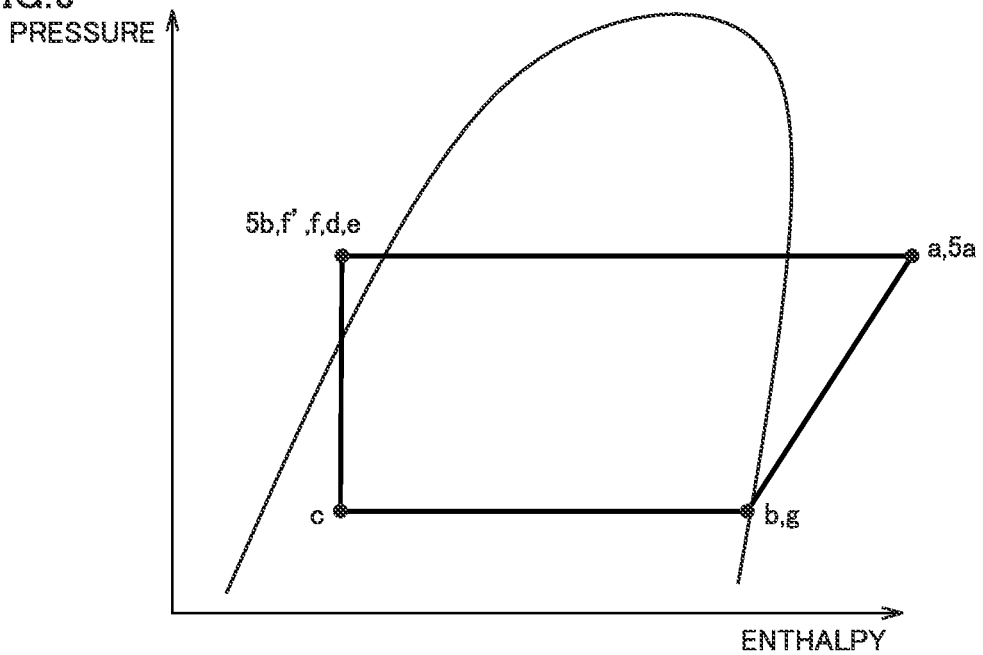
FIG. 6 is a p-h diagram showing a state change of the refrigerant in the second operation mode of refrigeration cycle apparatus 110 according to the first embodiment.

FIG. 6 is a p-h diagram showing a state change of the refrigerant in the second operation mode of refrigeration cycle apparatus 110 according to the first embodiment. Explanation will be made for FIG. 6 with reference to FIG. 4. By four-way valve 2 and third open/close valve V3, point a and point 5*a* in FIG. 1 communicate with each other. Further, by four-way valve 2, point b and point g in FIG. 1 communicate with each other.

The high-temperature and high-pressure gas refrigerant discharged from compressor 1 is condensed by second heat exchanger 5 as indicated by a line segment a, 5*a*-5*b, f', f, d* in FIG. 6, and is decompressed in first decompressor 4 as indicated by a line segment 5*b, f', f, d, e-c*. The liquid refrigerant decompressed in first decompressor 4 is evaporated in first heat exchanger 3 to become gas refrigerant as indicated by a line segment c-b, g. In this case, since second decompressor 8 is closed, there is no path through which the refrigerant having an intermediate pressure as indicated by point d in FIG. 5 flows out of gas-liquid separator 6, thus resulting in a simple p-h diagram in the second operation mode.

As described with reference to FIGS. 2 and 3, second heat exchanger 5 is configured such that the flow of air in second heat exchanger 5 and the flow of the refrigerant from the inlet (5*a*) to the outlet (5*b*) of second heat exchanger 5 are counter flows. Further, as shown in FIGS. 1 and 4, flow path switching apparatus 7 is controlled to cause the refrigerant in second heat exchanger 5 to flow in a direction from the inlet (5*a*) toward the outlet (5*b*) in each of the first operation mode and the second operation mode.

As described above, in refrigeration cycle apparatus 110 of the first embodiment, the flow of the refrigerant in second heat exchanger 5 can be a counter flow with respect to the flow of the air irrespective of whether the operation mode is the first operation mode or the second operation mode, thus resulting in improved heat transfer performance in second heat exchanger 5.

Further, part of the refrigerant to flow through second heat exchanger 5 and a tube is branched from gas-liquid separator 6 controlled to have an intermediate pressure so as to bypass second heat exchanger 5, thereby reducing pressure loss in the first operation mode. Thus, according to refrigeration cycle apparatus 110 of the first embodiment, heat exchange efficiency of the heat exchanger can be improved without deteriorating controllability for a flow rate of the flowing gas refrigerant.

Further, in the first operation mode, gas-liquid separator 6 serves to provide liquid refrigerant as the refrigerant flowing into the inlet of second heat exchanger 5 and to attain a low degree of dryness, thus resulting in improved distribution of the refrigerant in the distributor (5*a*).

Modification of First Embodiment.

In a modification of the first embodiment, the gas-liquid separator is controlled to be in an intermediate pressure state during an operation in which the low-pressure refrigerant flows into second heat exchanger 5, and the state of the refrigerant at the outlet of second heat exchanger 5 is controlled to attain a target value (for example, a saturated state).

Figure 7:
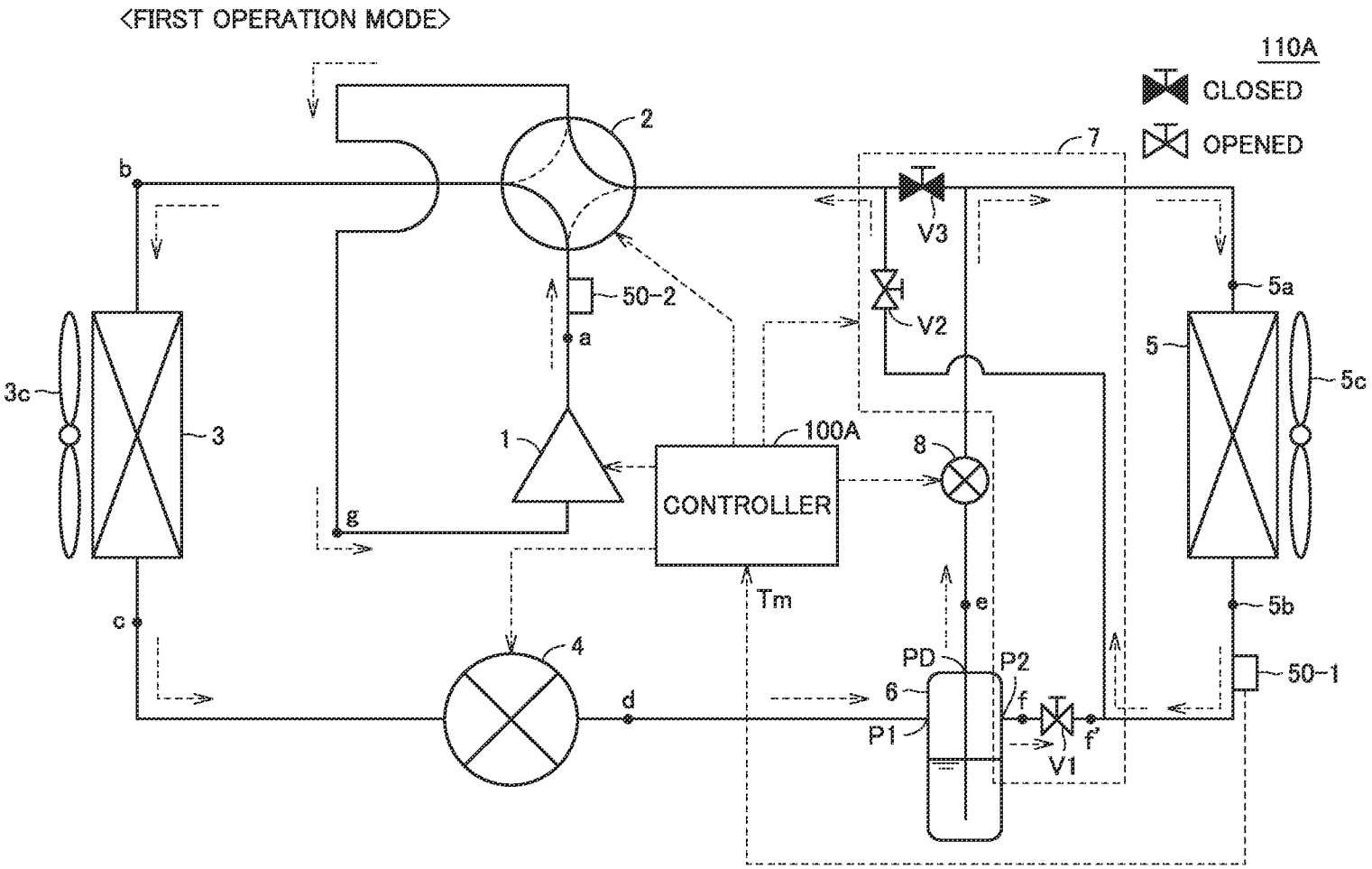
FIG. 7 is a refrigerant circuit diagram showing a configuration of a refrigeration cycle apparatus 110A according to a modification of the first embodiment.

FIG. 7 is a refrigerant circuit diagram showing a configuration of a refrigeration cycle apparatus 110A according to the modification of the first embodiment. Refrigeration cycle apparatus 110A includes a controller 100A instead of controller 100 in the configuration of refrigeration cycle apparatus 110 of the first embodiment, and further includes sensors 50-1, 50-2. The configurations of the other portions of refrigeration cycle apparatus 110A are the same as those of refrigeration cycle apparatus 110, and therefore will not be described repeatedly.

Sensor 50-1 is a temperature sensor configured to detect a state of the refrigerant at the merging portion (5*b*) of second heat exchanger 5. Sensor 50-1 may be a pressure sensor. Further, sensor 50-2 is a temperature sensor configured to detect a discharge temperature of compressor 1.

Controller 100A controls second decompressor 8 to cause a detection value of sensor 50-1 or 50-2 to be a target value.

Figure 8:
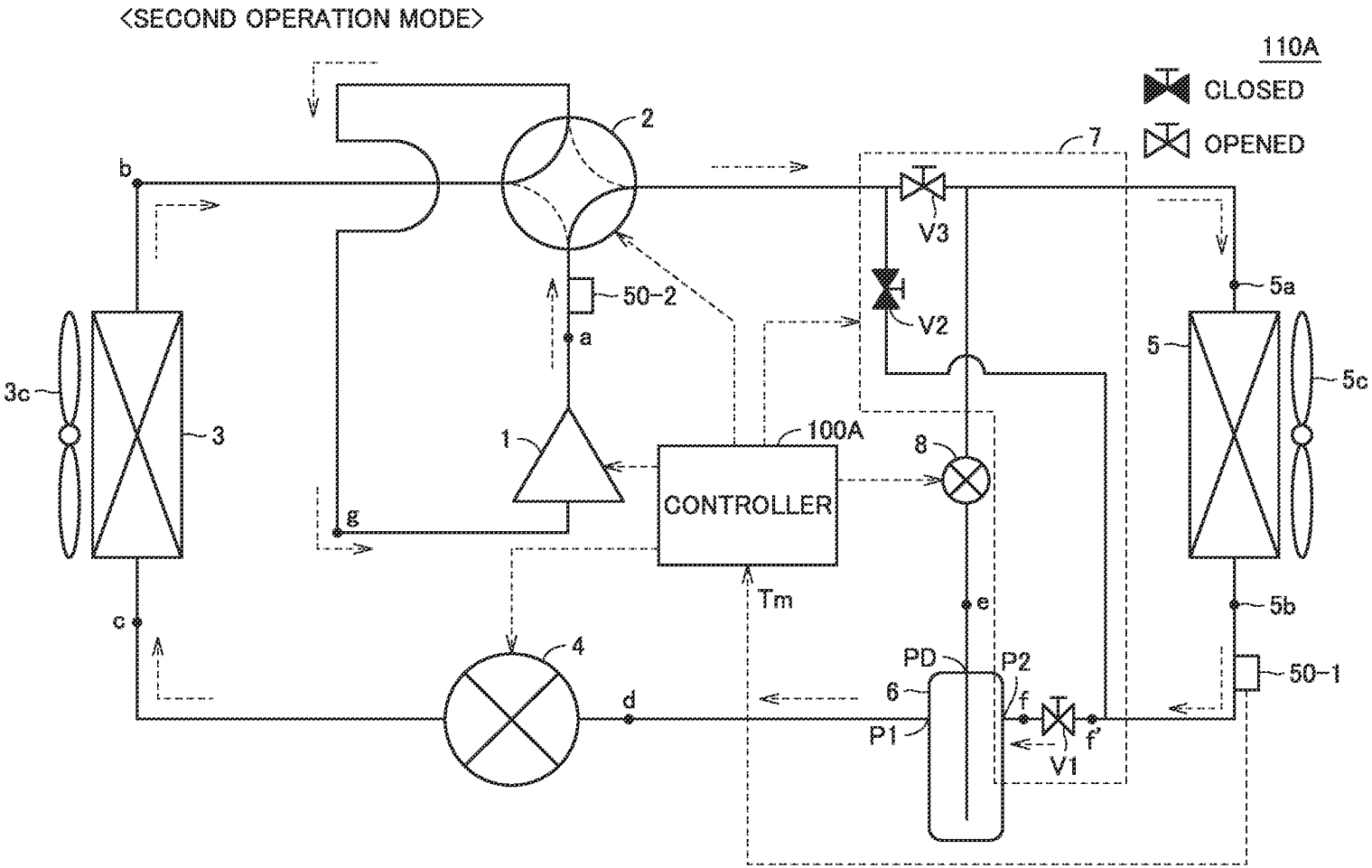
FIG. 8 is a diagram showing a flow of the refrigerant in the second operation mode of refrigeration cycle apparatus 110A.

FIG. 7 shows a flow of the refrigerant in the first operation mode of refrigeration cycle apparatus 110A. FIG. 8 is a diagram showing a flow of the refrigerant in the second operation mode of refrigeration cycle apparatus 110A. The flows of the refrigerant are the same as those of the first embodiment, and therefore will not be described repeatedly.

Figure 9:
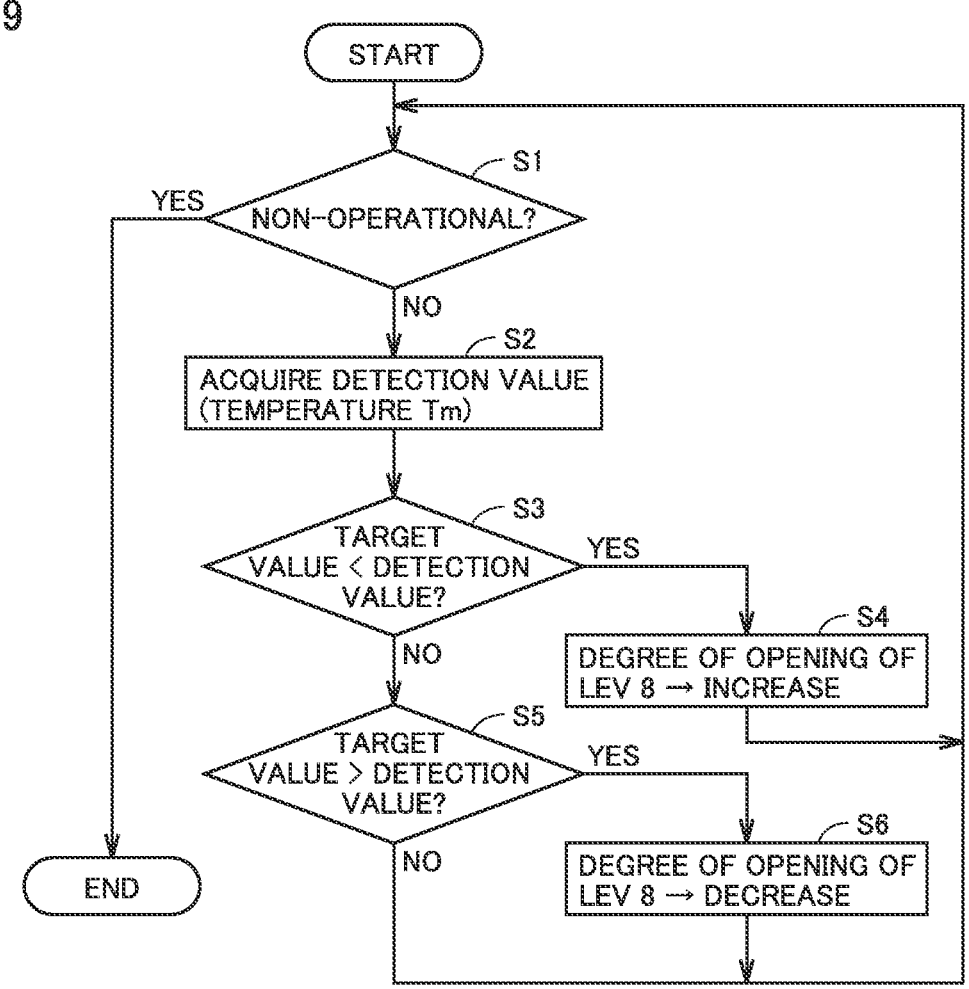
FIG. 9 is a flowchart for illustrating control of a second decompressor 8 in the modification of the first embodiment.

FIG. 9 is a flowchart for illustrating control of second decompressor 8 in the modification of the first embodiment. When a process of this flowchart is started, in a step S1, controller 100A determines whether or not refrigeration cycle apparatus 110A is non-operational. When refrigeration cycle apparatus 110A is non-operational (YES in S1), the process is ended.

On the other hand, when refrigeration cycle apparatus 110A is operational (NO in S1), controller 100A acquires a detection value from sensor 50-1 in a step S2. Then, in a step S3, controller 100A determines whether or not the detection value (temperature Tm in one example) acquired from sensor 50-1 is more than the target value.

When the target value<the detection value is satisfied (YES in S3), controller 100A increases a degree of opening of second decompressor 8 in a step S4. Thus, temperature Tm is decreased, with the result that the detection value can be expected to come close to the target value.

On the other hand, when the target value<the detection value is not satisfied (NO in S3), controller 100A determines whether or not the detection value is less than the target value in a step S5.

When the target value>the detection value is satisfied (YES in S5), controller 100A decreases the degree of opening of second decompressor 8 in a step S6. Thus, temperature Tm is increased, with the result that the detection value can be expected to come close to the target value.

On the other hand, when the target value>the detection value is not satisfied (NO in S5), the detection value is equal to the target value, so that controller 100A returns the process to repeat the process from step S1.

As described above, in refrigeration cycle apparatus 110A according to the modification of the first embodiment, the state of the refrigerant at the outlet of second heat exchanger 5 can be controlled by using second decompressor 8 in the first operation mode (low-pressure operation mode), thus resulting in further improved heat transfer performance of second heat exchanger 5 as compared with refrigeration cycle apparatus 110 according to the first embodiment.

Second Embodiment

In a second embodiment, the following describes configuration and control to hold an excess of the refrigerant in gas-liquid separator 6 by attaining an intermediate pressure state using a third decompressor 9 during the operation in which the high-pressure refrigerant flows into second heat exchanger 5.

Figure 10:
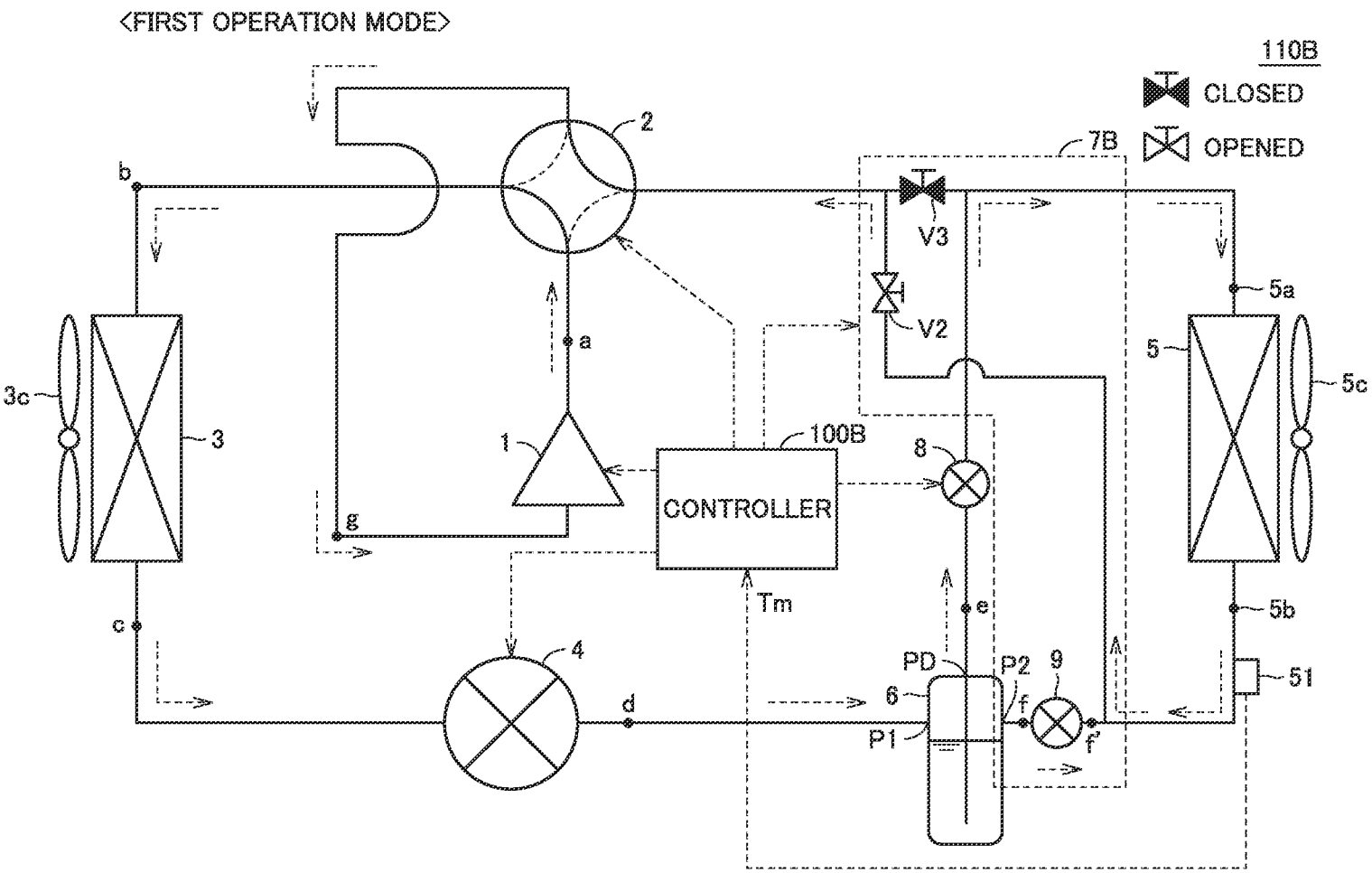
FIG. 10 is a refrigerant circuit diagram showing a configuration of a refrigeration cycle apparatus 110B according to a second embodiment.

FIG. 10 is a refrigerant circuit diagram showing a configuration of a refrigeration cycle apparatus 110B according to the second embodiment. Refrigeration cycle apparatus 110B includes third decompressor 9 and a controller 100B instead of first open/close valve V1 and controller 100 in the configuration of refrigeration cycle apparatus 110 of the first embodiment, and further includes a sensor 51. The configurations of the other portions of refrigeration cycle apparatus 110B are the same as those of refrigeration cycle apparatus 110, and therefore will not be described repeatedly. For example, an electronic expansion valve (LEV) can be used as third decompressor 9.

Sensor 51 detects the state of the refrigerant at the outlet of second heat exchanger 5 in the second operation mode (high-pressure operation mode). Sensor 51 includes, for example, a temperature sensor and a pressure sensor. Controller 100B controls third decompressor 9 to cause a detection value of sensor 51 to be a target value.

The flow of the refrigerant in the first operation mode will be described with reference to FIG. 10. In the first operation mode, the refrigerant flows mainly in the order of compressor 1, four-way valve 2, first heat exchanger 3, first decompressor 4, gas-liquid separator 6, second decompressor 8, a flow path switching apparatus 7B, the inlet (5*a*) of second heat exchanger 5, the outlet (5*b*) of second heat exchanger 5, flow path switching apparatus 7B, four-way valve 2, and compressor 1. Two-phase refrigerant having flowed into gas-liquid separator 6 is separated into a gas and a liquid. The refrigerant in the liquid state flows from gas-liquid separator 6 into second decompressor 8, and is decompressed. The decompressed refrigerant flows into the inlet (5*a*) of second heat exchanger 5. On the other hand, the refrigerant in the gaseous state flows from gas-liquid separator 6 into a portion between compressor 1 and the outlet (5*b*) of second heat exchanger 5. The refrigerant at the inlet (5*a*) of second heat exchanger 5 performs heat exchange while flowing to counter the flow of air as shown in FIGS. 2 and 3, and flows out of the outlet (5*b*) of second heat exchanger 5. The refrigerant having flowed out of the outlet (5*b*) of second heat exchanger 5 is merged at a point f with the refrigerant in the gaseous state, passes through second open/close valve V2 and four-way valve 2, and is returned to compressor 1.

Figure 11:
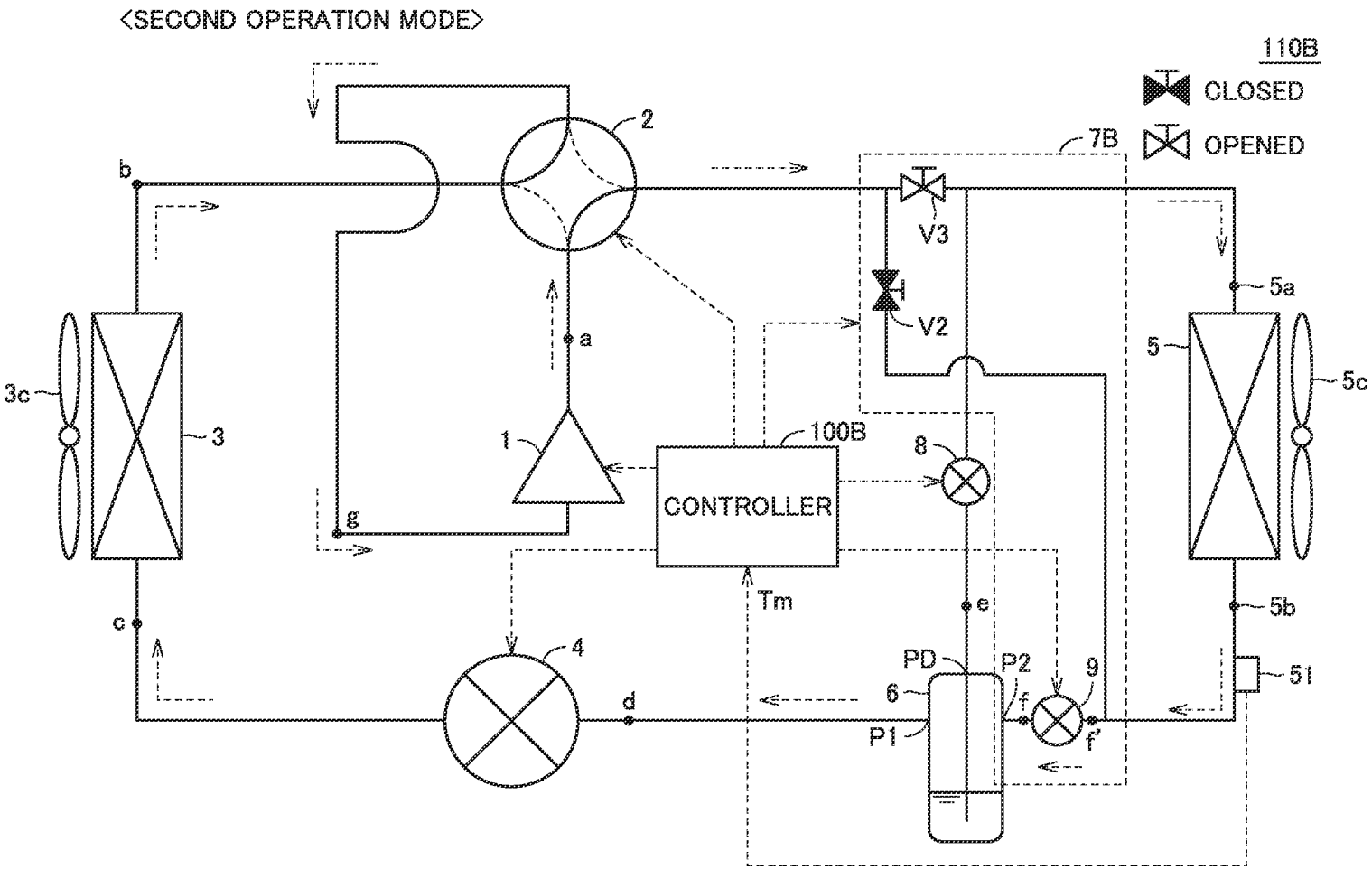
FIG. 11 is a diagram showing a flow of the refrigerant in the second operation mode of refrigeration cycle apparatus 110B.

FIG. 11 is a diagram showing a flow of the refrigerant in the second operation mode of refrigeration cycle apparatus 110B. In the second operation mode (high-pressure operation mode), controller 100B controls four-way valve 2 to form, in four-way valve 2, a flow path indicated by a solid line in FIG. 11. On this occasion, controller 100B opens third open/close valve V3, and closes second open/close valve V2 and second decompressor 8.

Thus, in the second operation mode (high-pressure operation mode), the refrigerant circuit is configured to circulate the refrigerant in the order of compressor 1, four-way valve 2, flow path switching apparatus 7B, the distributor (5*a*) of second heat exchanger 5, the merging portion (5*b*) of second heat exchanger 5, flow path switching apparatus 7B, third decompressor 9, gas-liquid separator 6, first decompressor 4, first heat exchanger 3, four-way valve 2, and compressor 1.

Figure 12:
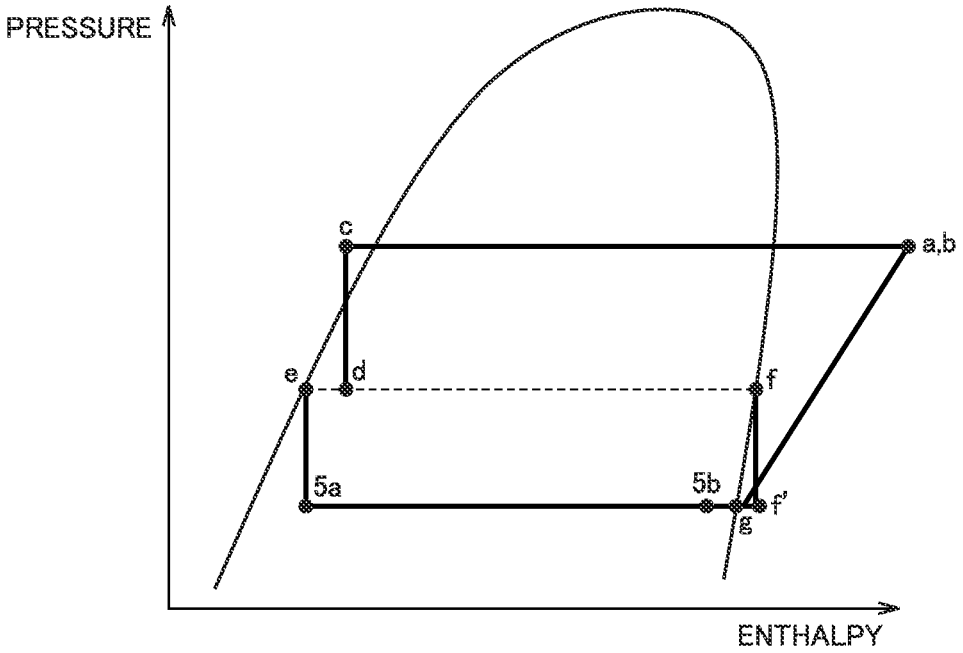
FIG. 12 is a p-h diagram showing a state change of the refrigerant in the first operation mode of refrigeration cycle apparatus 110B according to the second embodiment.

FIG. 12 is a p-h diagram showing a state change of the refrigerant in the first operation mode of refrigeration cycle apparatus 110B according to the second embodiment. Explanation will be made for FIG. 12 with reference to FIG. 10. By four-way valve 2, a point a and a point b in FIG. 10 communicate with each other. Further, by four-way valve 2 and second open/close valve V2, point g and point f in FIG. 10 communicate with each other.

The high-temperature and high-pressure gas refrigerant discharged from compressor 1 is condensed by first heat exchanger 3 as indicated by a line segment a, b-c in FIG. 12, is decompressed in first decompressor 4 as indicated by a line segment c-d, and flows into gas-liquid separator 6. The liquid refrigerant, separated by gas-liquid separator 6, at an intermediate pressure point e is further decompressed by second decompressor 8 as indicated by a line segment e-5*a*, and is evaporated in second heat exchanger 5 as indicated by a line segment 5*a*-5*b* to become gas refrigerant. On the other hand, the gas refrigerant, separated by gas-liquid separator 6, at an intermediate pressure point f is decompressed by third decompressor 9 as indicated by a line segment f-f, is merged with the gas refrigerant at point 5*b*, and is then suctioned into compressor 1 (point g).

Figure 13:
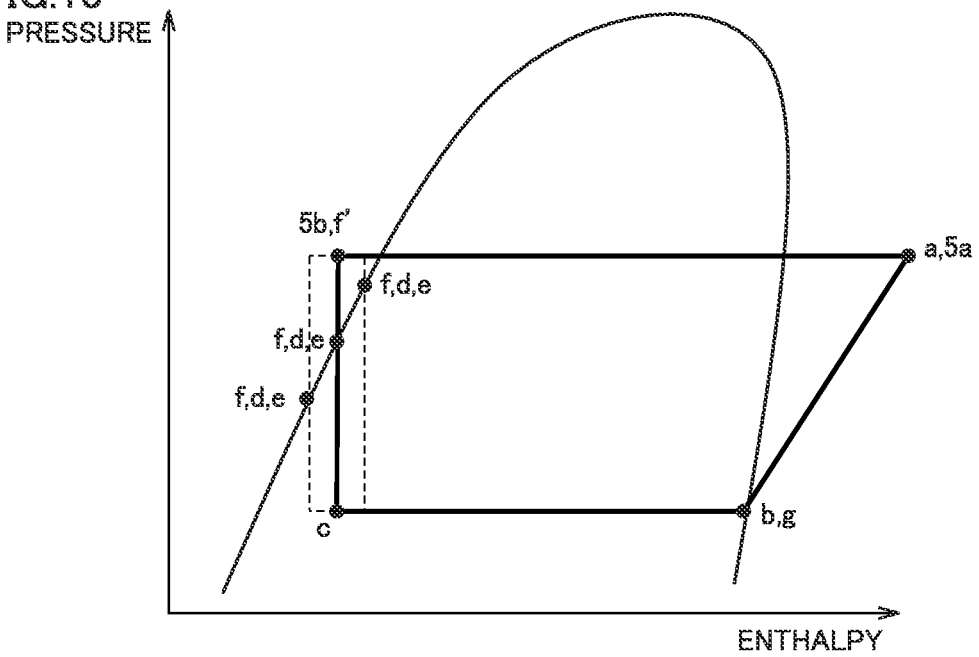
FIG. 13 is a p-h diagram showing a state change of the refrigerant in the second operation mode of refrigeration cycle apparatus 110B according to the second embodiment.

FIG. 13 is a p-h diagram showing a state change of the refrigerant in the second operation mode of refrigeration cycle apparatus 110B according to the second embodiment. Explanation will be made for FIG. 13 with reference to FIG. 11. By four-way valve 2 and third open/close valve V3, point a and point 5*a* in FIG. 11 communicate with each other. Further, by four-way valve 2, point b and point g in FIG. 11 communicate with each other.

The high-temperature and high-pressure gas refrigerant discharged from compressor 1 is condensed by second heat exchanger 5 as indicated by a line segment a, 5*a*-5*b*, P. Further, the refrigerant is decompressed in first decompressor 4 as indicated by a line segment 5*b, f-c*. The liquid refrigerant decompressed in first decompressor 4 is evaporated in first heat exchanger 3 to become gas refrigerant as indicated by a line segments c-b, g. In this case, since second decompressor 8 is closed, there is no path through which the refrigerant at the intermediate pressure flows out of gas-liquid separator 6 as indicated by point d in FIG. 12, thus resulting in a simple p-h diagram in the second operation mode.

In this state, when the degree of opening of third decompressor 9 is changed, a straight line 5*b, f-c* is translated in a direction of increase/decrease of enthalpy on the p-h diagram as indicated by a broken line in FIG. 13. Since a point f, d, e indicates pressure of gas-liquid separator 6 and is a point of intersection with a liquidus line, the pressure of gas-liquid separator 6 can be freely changed by changing the degree of opening of third decompressor 9. Therefore, in the second operation mode, an amount of refrigerant circulated in the refrigeration cycle can be adjusted.

Figure 14:
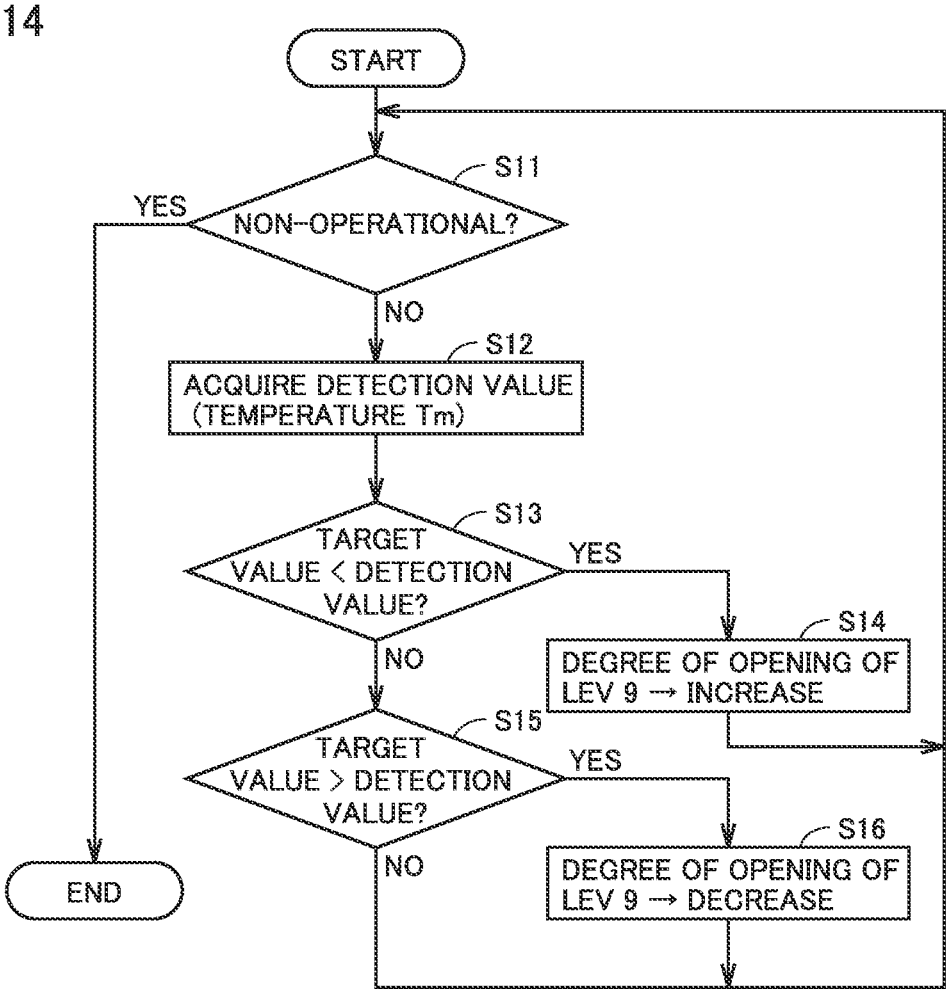
FIG. 14 is a flowchart for illustrating control of a third decompressor 9 in the second embodiment.

FIG. 14 is a flowchart illustrating control of third decompressor 9 according to the second embodiment. When the process of this flowchart is started, in a step S11, controller 100B determines whether or not refrigeration cycle apparatus 110B is non-operational. When refrigeration cycle apparatus 110B is non-operational (YES in S11), the process is ended.

On the other hand, when refrigeration cycle apparatus 110B is operational (NO in S11), controller 100B acquires a detection value from sensor 51 in a step S12. Then, in a step S13, controller 100B determines whether or not the detection value (temperature Tm in one example) acquired from sensor 51 is more than a target value.

When the target value<the detection value is satisfied (YES in S13), controller 100B increases a degree of opening of third decompressor 9 in a step S14. Thus, temperature Tm is decreased, with the result that the detection value can be expected to come close to the target value.

On the other hand, when the target value<the detection value is not satisfied (NO in S13), controller 100B determines whether or not the detection value is less than the target value in a step S15.

When the target value>the detection value is satisfied (YES in S15), controller 100B decreases the degree of opening of third decompressor 9 in a step S16. Thus, temperature Tm is increased, with the result that the detection value can be expected to come close to the target value.

On the other hand, when the target value>the detection value is not satisfied (NO in S15), the detection value is equal to the target value, so that controller 100B returns the process to repeat the process from step S11.

As described above, in refrigeration cycle apparatus 110B of the second embodiment, an amount of refrigerant stored in gas-liquid separator 6 can be adjusted by using third decompressor 9 in the second operation mode (high-pressure operation mode), thus resulting in further improved air conditioning performance as compared with refrigeration cycle apparatus 110 of the first embodiment.

Further, since the amount of excess of refrigerant stored in gas-liquid separator 6 can be adjusted, the amount of refrigerant sealed in the refrigeration cycle apparatus can be reduced to an amount close to the minimum necessary amount, thereby reducing an environmental load.

Third Embodiment

In a third embodiment, the following describes configuration and control to bring the refrigerant to be suctioned into the compressor into a saturated state or a superheated state in the following manner: an internal heat exchanger is installed in the gas-liquid separator to exchange heat between the refrigerant exiting from the evaporator and the refrigerant in the gas-liquid separator so as to attain two phases at the outlet of the evaporator.

Figure 15:
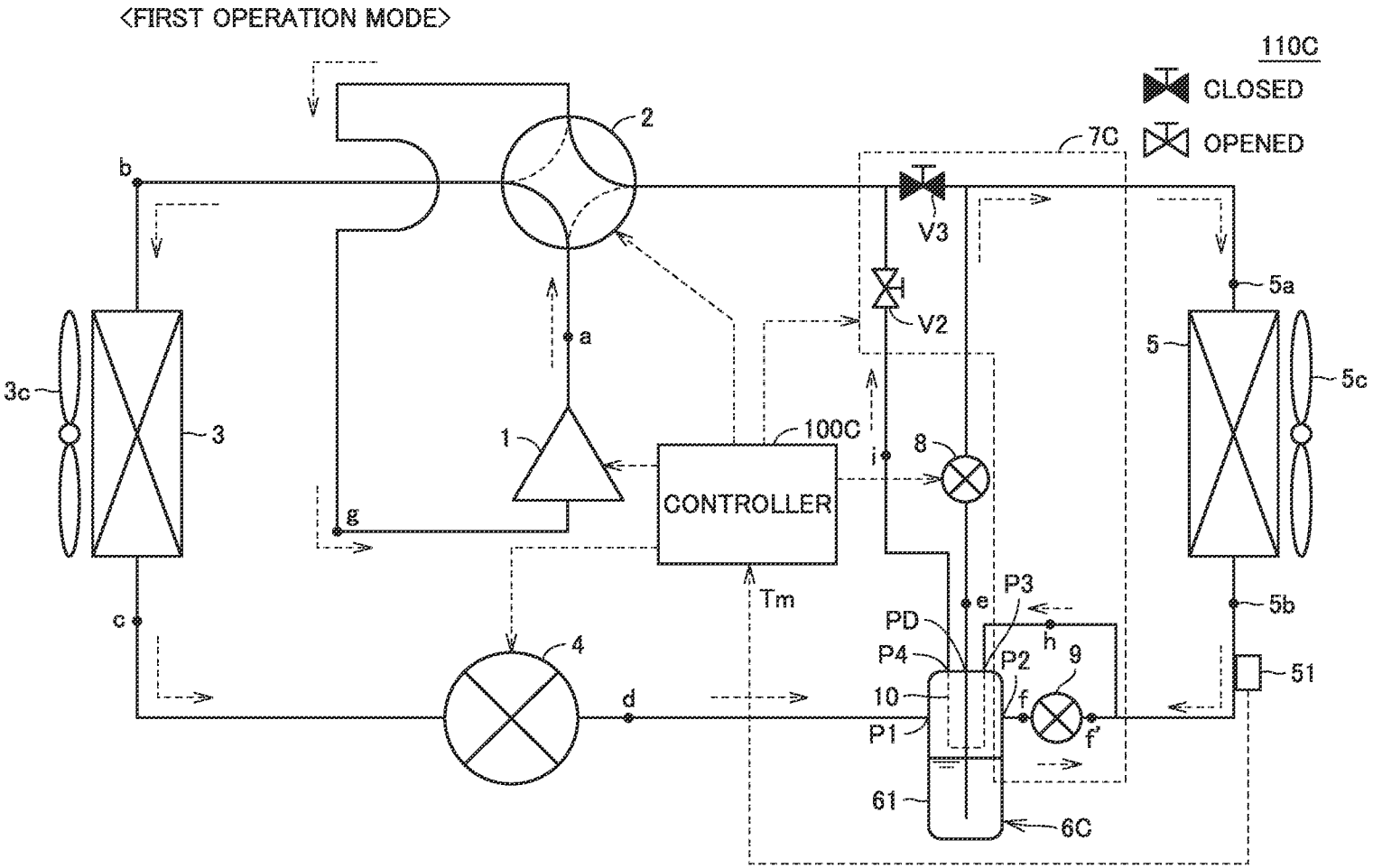
FIG. 15 is a refrigerant circuit diagram showing a configuration of a refrigeration cycle apparatus 110C according to a third embodiment.

FIG. 15 is a refrigerant circuit diagram showing a configuration of a refrigeration cycle apparatus 110C according to the third embodiment. Refrigeration cycle apparatus 110C includes a gas-liquid separator 6C, a flow path switching apparatus 7C, and a controller 100C instead of gas-liquid separator 6, flow path switching apparatus 7B, and controller 100B in the configuration of refrigeration cycle apparatus 110B of the second embodiment. The configurations of the other portions of refrigeration cycle apparatus 110C are the same as those of refrigeration cycle apparatus 110B, and therefore will not be described repeatedly.

In addition to the configuration of gas-liquid separator 6 shown in FIG. 10, gas-liquid separator 6C further includes a refrigerant path 10 connected between ports P3 and P4 and acting as an internal heat exchanger. Refrigerant path 10 extends inside gas-liquid separator 6C. Heat exchange is performed between the refrigerant stored in gas-liquid separator 6C and the refrigerant flowing through refrigerant path 10.

The flow of the refrigerant in the first operation mode will be described with reference to FIG. 15. In the first operation mode (high-pressure operation mode), controller 100C controls four-way valve 2 to form, in four-way valve 2, a flow path indicated by a solid line in FIG. 15. On this occasion, controller 100C opens second open/close valve V2 and second decompressor 8, and closes third open/close valve V3.

As a result, in the first operation mode, the refrigerant flows in the order of compressor 1, four-way valve 2, first heat exchanger 3, first decompressor 4, gas-liquid separator 6C, second decompressor 8, flow path switching apparatus 7C, the inlet (5*a*) of second heat exchanger 5, the outlet (5*b*) of second heat exchanger 5, flow path switching apparatus 7C, four-way valve 2, and compressor 1. Two-phase refrigerant having flowed into gas-liquid separator 6C is separated into a gas and a liquid. The refrigerant in the liquid state flows from gas-liquid separator 6C into second decompressor 8, and is decompressed. The decompressed refrigerant flows into the inlet (5*a*) of second heat exchanger 5. On the other hand, the refrigerant in the gaseous state flows from gas-liquid separator 6C into a portion between compressor 1 and the outlet (5*b*) of second heat exchanger 5. The refrigerant at the inlet (5*a*) of second heat exchanger 5 performs heat exchange while flowing to counter the flow of air as shown in FIGS. 2 and 3, and flows out of the outlet (5*b*) of second heat exchanger 5. The refrigerant having flowed out of the outlet (5*b*) of second heat exchanger 5 is merged with the refrigerant in the gaseous state at a point f, passes through refrigerant path 10, second open/close valve V2, and four-way valve 2, and is returned to compressor 1. On this occasion, the refrigerant passing through refrigerant path 10 exchanges heat with the refrigerant having an intermediate pressure and stored in gas-liquid separator 6C.

Figure 16:
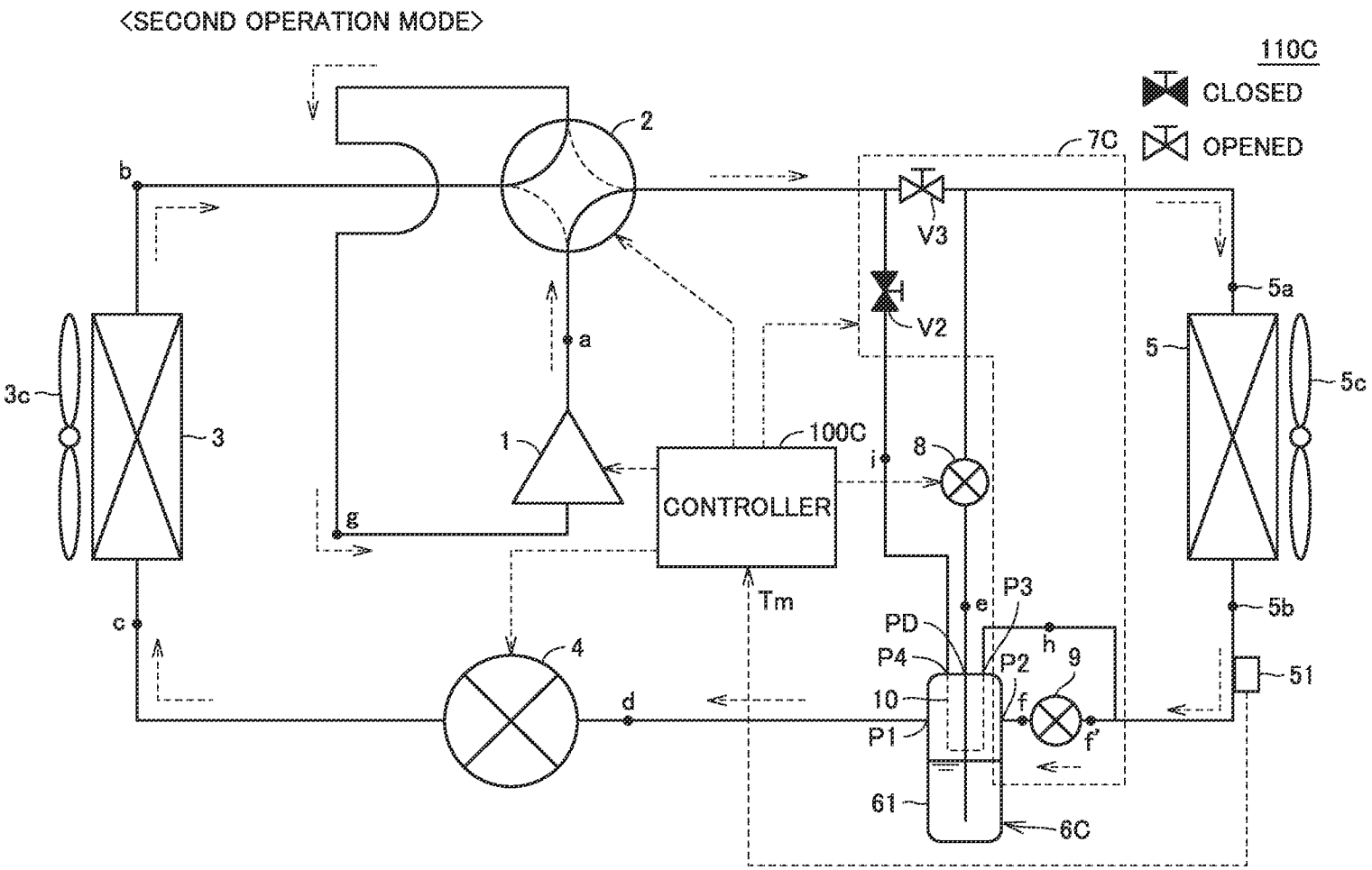
FIG. 16 is a diagram showing a flow of the refrigerant in the second operation mode of refrigeration cycle apparatus 110C.

FIG. 16 is a diagram showing a flow of the refrigerant in the second operation mode of refrigeration cycle apparatus 110C. In the second operation mode (high-pressure operation mode), controller 100C controls four-way valve 2 to form, in four-way valve 2, a flow path indicated by a solid line in FIG. 16. On this occasion, controller 100C opens third open/close valve V3, and closes second open/close valve V2 and second decompressor 8.

Thus, in the second operation mode (high-pressure operation mode), the refrigerant circuit is configured to circulate the refrigerant in the order of compressor 1, four-way valve 2, flow path switching apparatus 7C, the distributor (5*a*) of second heat exchanger 5, the merging portion (5*b*) of second heat exchanger 5, flow path switching apparatus 7C, third decompressor 9, gas-liquid separator 6C, first decompressor 4, first heat exchanger 3, four-way valve 2, and compressor 1.

Figure 17:
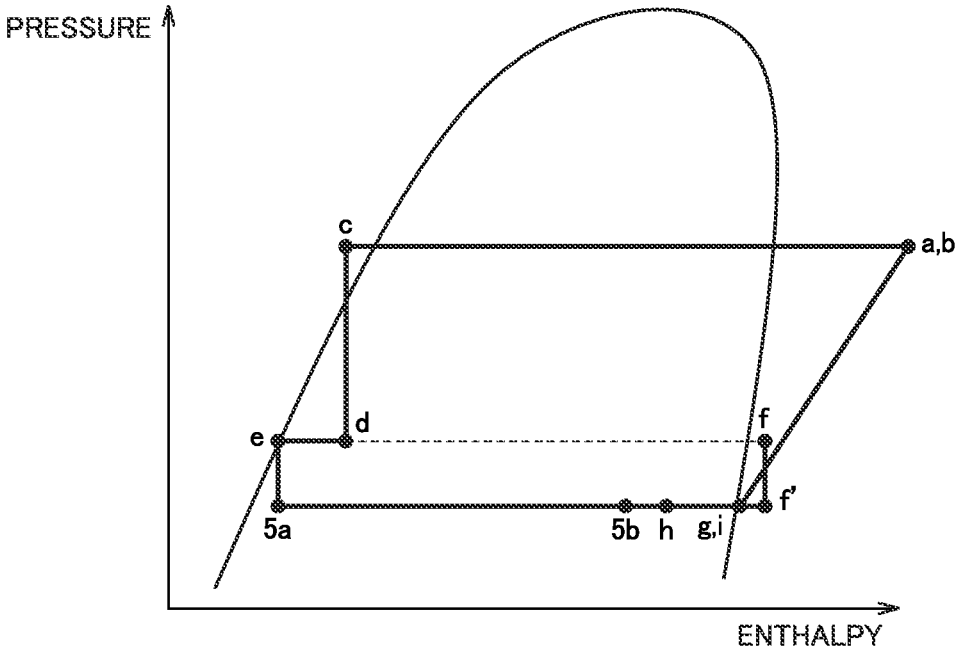
FIG. 17 is a p-h diagram showing a state change of the refrigerant in the first operation mode of refrigeration cycle apparatus 110C according to the third embodiment.

FIG. 17 is a p-h diagram showing a state change of the refrigerant in the first operation mode of refrigeration cycle apparatus 110C according to the third embodiment. Explanation will be made for FIG. 17 with reference to FIG. 15. By four-way valve 2, a point a and a point b in FIG. 15 communicate with each other. Further, by four-way valve 2 and second open/close valve V2, a point g and a point i in FIG. 15 communicate with each other.

The high-temperature and high-pressure gas refrigerant discharged from compressor 1 is condensed by first heat exchanger 3 as indicated by a line segment a, b-c, is decompressed in first decompressor 4 as indicated by a line segment c-d, and flows into gas-liquid separator 6. The liquid refrigerant, separated by gas-liquid separator 6C, at an intermediate pressure point e is further decompressed by second decompressor 8 as indicated by a line segment e-5*a*, and is evaporated in second heat exchanger 5 as indicated by a line segment 5*a*-5*b* to become gas refrigerant. On the other hand, the gas refrigerant, separated by gas-liquid separator 6C, at an intermediate pressure point f is merged at a point h with the gas refrigerant at a point 5*b* via third decompressor 9 as indicated by a line segment f-f, exchanges heat with the refrigerant having an intermediate pressure and located in gas-liquid separator 6C as indicated by a line segment h-g, i, therefore absorbs heat, and is suctioned into compressor 1 (point g).

Figure 18:
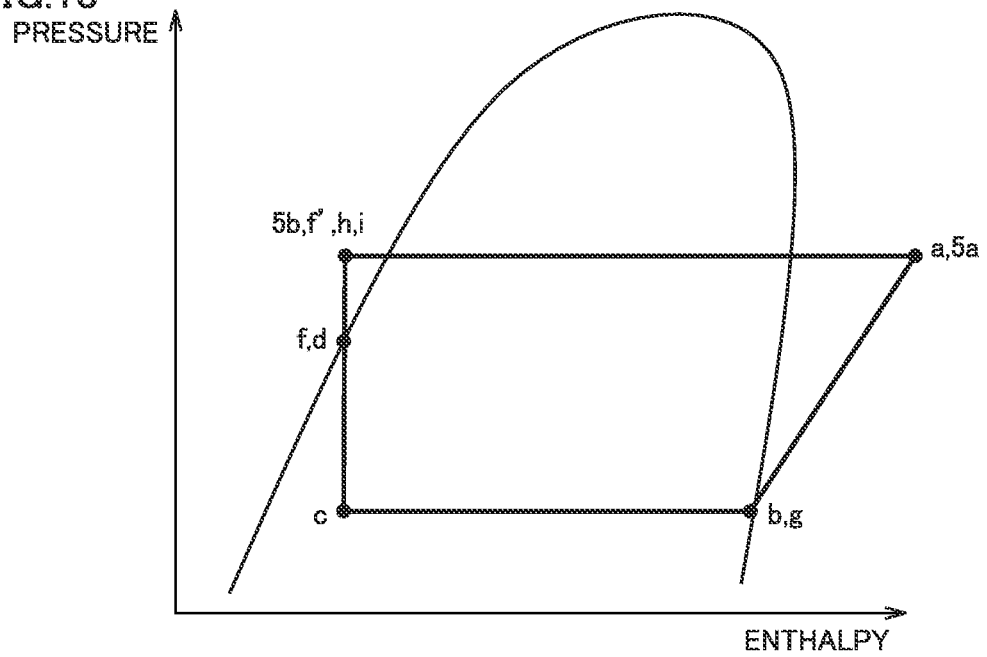
FIG. 18 is a p-h diagram showing a state change of the refrigerant in the second operation mode of refrigeration cycle apparatus 110C according to the third embodiment.

FIG. 18 is a p-h diagram showing a state change of the refrigerant in the second operation mode of refrigeration cycle apparatus 110C according to the third embodiment. Explanation will be made for FIG. 18 with reference to FIG. 16. By four-way valve 2 and third open/close valve V3, point a and point 5*a* in FIG. 16 communicate with each other. Further, by four-way valve 2, point b and point g in FIG. 16 communicate with each other.

The high-temperature and high-pressure gas refrigerant discharged from compressor 1 is condensed by second heat exchanger 5 as indicated by a line segment a, 5*a*-5*b, f, h, i*. Further, the refrigerant is decompressed in first decompressor 4 as indicated by a line segments 5*b, f-c*. The liquid refrigerant decompressed in first decompressor 4 is evaporated in first heat exchanger 3 to become gas refrigerant as indicated by a line segment c-b. In this case, since second decompressor 8 is closed, there is no path through which the refrigerant having an intermediate pressure as indicated by point d in FIG. 17 flows out of gas-liquid separator 6, thus resulting in a simple p-h diagram in the second operation mode.

According to refrigeration cycle apparatus 110C of the third embodiment, the state of the refrigerant at the outlet of second heat exchanger 5 is the two-phase state in the first operation mode (low-pressure operation mode), thus resulting in improved heat transfer performance of second heat exchanger 5.

Further, by controlling the state of the refrigerant suctioned to compressor 1 to be the saturated state or the superheated state, heat insulating efficiency and volumetric efficiency of compressor 1 can be improved, thereby ensuring reliability of compressor 1.

Fourth Embodiment

In a fourth embodiment, the following describes configuration and control to switch tubes to which the gas refrigerant and the liquid refrigerant of the gas-liquid separator flow out, at the same time as the switching of the operation mode.

Figure 19:
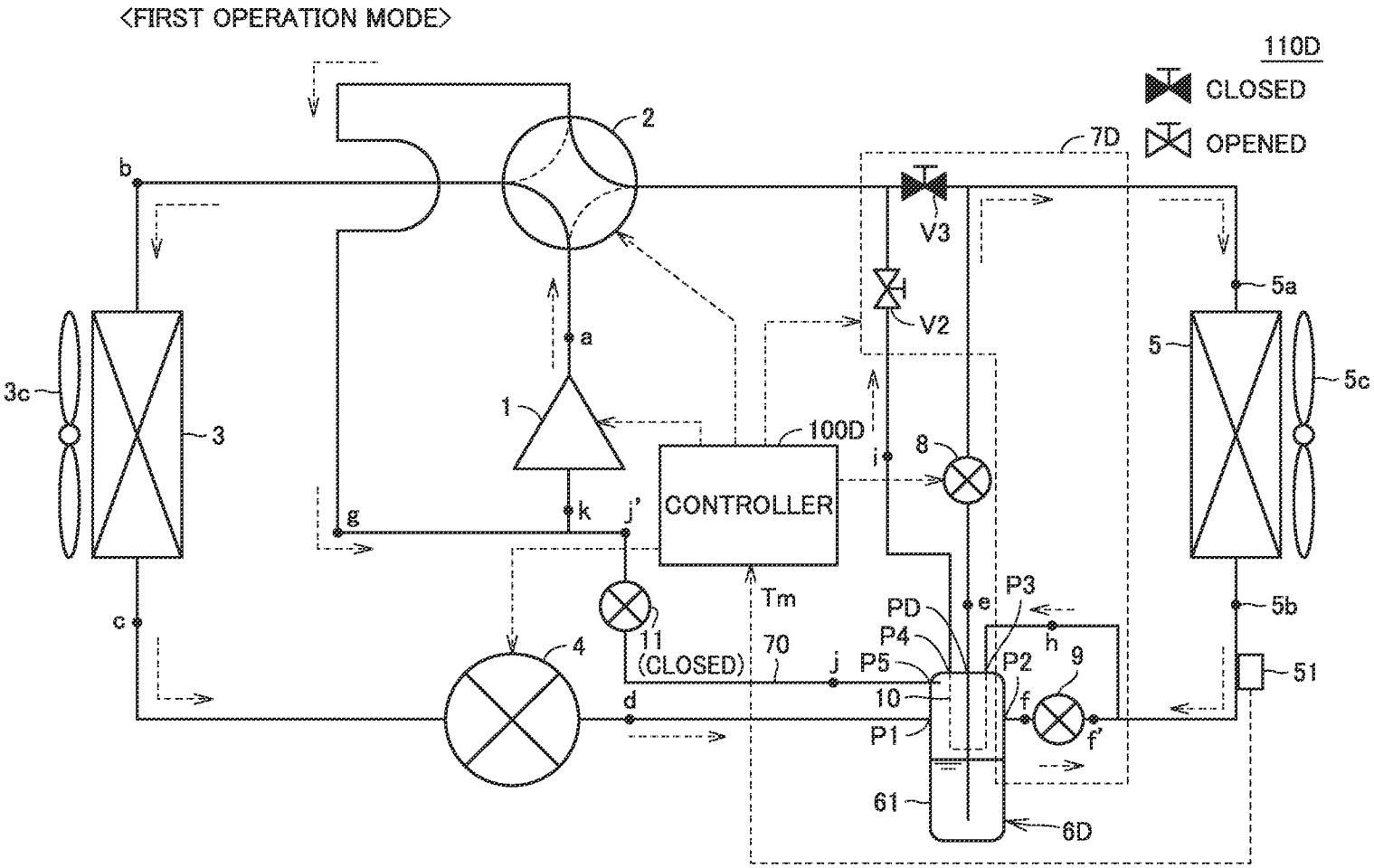
FIG. 19 is a refrigerant circuit diagram showing a configuration of a refrigeration cycle apparatus 110D according to a fourth embodiment.

FIG. 19 is a refrigerant circuit diagram showing a configuration of a refrigeration cycle apparatus 110D according to the fourth embodiment. Refrigeration cycle apparatus 110D includes a gas-liquid separator 6D, a flow path switching apparatus 7D, and a controller 100D instead of gas-liquid separator 6C, flow path switching apparatus 7C, and controller 100C in the configuration of refrigeration cycle apparatus 110C of the third embodiment, and further includes a bypass flow path 70 and a bypass valve 11. The configurations of the other portions of refrigeration cycle apparatus 110D are the same as those of refrigeration cycle apparatus 110C, and therefore will not be described repeatedly.

Gas-liquid separator 6D is further provided with a port P5 connected to bypass flow path 70, in addition to the configuration of gas-liquid separator 6C shown in FIG. 15. Port P5 is provided at a position higher than the heights of ports P1 and P2. Bypass flow path 70 is provided between port P5 and the suction portion of compressor 1. A bypass valve 11 is disposed at a certain portion of bypass flow path 70 and can adjust a flow rate of the refrigerant and block the flow of the refrigerant.

The flow of the refrigerant in the first operation mode will be described with reference to FIG. 19. In the first operation mode (high-pressure operation mode), controller 100D controls four-way valve 2 to form, in four-way valve 2, a flow path indicated by a solid line in FIG. 19. On this occasion, controller 100C opens the third decompressor, second open/close valve V2, and second decompressor 8, and closes third open/close valve V3 and bypass valve 11.

As a result, in the first operation mode, the refrigerant mainly flows in the order of compressor 1, four-way valve 2, first heat exchanger 3, first decompressor 4, gas-liquid separator 6D, second decompressor 8, flow path switching apparatus 7D, the inlet (5*a*) of second heat exchanger 5, the outlet (5*b*) of second heat exchanger 5, flow path switching apparatus 7D, four-way valve 2, and compressor 1. Two-phase refrigerant having flowed into gas-liquid separator 6D is separated into a gas and a liquid. The refrigerant in the liquid state flows from gas-liquid separator 6D into second decompressor 8, and is decompressed. The decompressed refrigerant flows into the inlet (5*a*) of second heat exchanger 5. On the other hand, the refrigerant in the gaseous state flows from gas-liquid separator 6D into a portion between compressor 1 and the outlet (5*b*) of second heat exchanger 5. The refrigerant at the inlet (5*a*) of second heat exchanger 5 performs heat exchange while flowing to counter the flow of air as shown in FIGS. 2 and 3, and flows out of the outlet (5*b*) of second heat exchanger 5. The refrigerant having flowed out of the outlet (5*b*) of second heat exchanger 5 is merged at a point f with the refrigerant in the gaseous state, passes through refrigerant path 10, second open/close valve V2, and four-way valve 2, and is returned to compressor 1. On this occasion, the refrigerant passing through refrigerant path 10 exchanges heat with the refrigerant having an intermediate pressure and stored in gas-liquid separator 6C.

Figure 20:
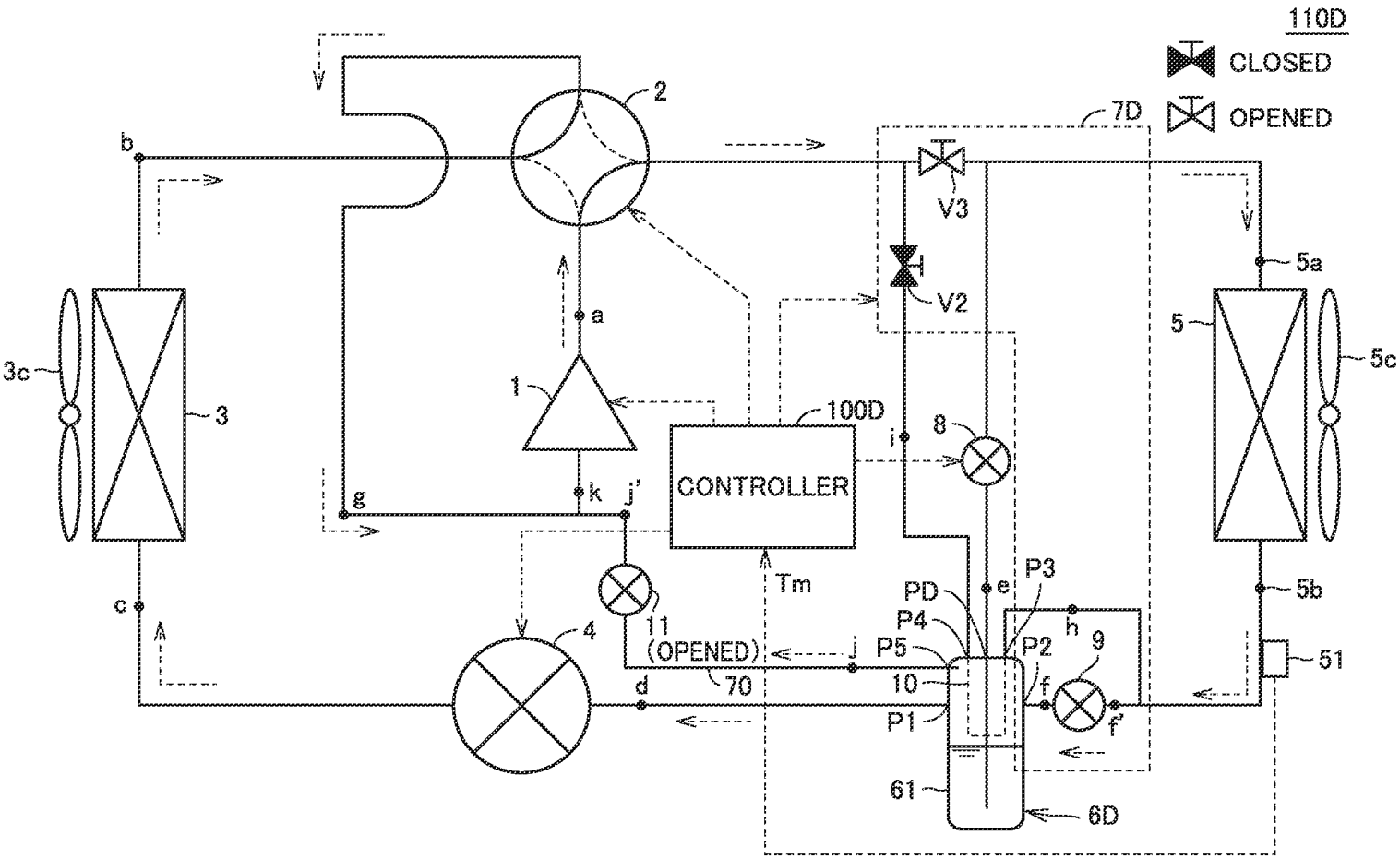
FIG. 20 is a diagram showing a flow of the refrigerant in the second operation mode of refrigeration cycle apparatus 110D.

FIG. 20 is a diagram showing a flow of the refrigerant in the second operation mode of refrigeration cycle apparatus 110D. In the second operation mode (high-pressure operation mode), controller 100D controls four-way valve 2 to form, in four-way valve 2, a flow path indicated by a solid line in FIG. 20. On this occasion, controller 100D opens third open/close valve V3 and bypass valve 11, and closes second open/close valve V2 and second decompressor 8.

Thus, in the second operation mode (high-pressure operation mode), a main refrigerant circuit is configured to circulate the refrigerant in the order of compressor 1, four-way valve 2, flow path switching apparatus 7D, the distributor (5*a*) of second heat exchanger 5, the merging portion (5*b*) of second heat exchanger 5, flow path switching apparatus 7D, third decompressor 9, gas-liquid separator 6D, first decompressor 4, first heat exchanger 3, four-way valve 2, and compressor 1. Further, by opening bypass valve 11, part of the gas refrigerant having an intermediate pressure and located inside gas-liquid separator 6D flows to the suction portion of compressor 1 through bypass flow path 70.

Figure 21:
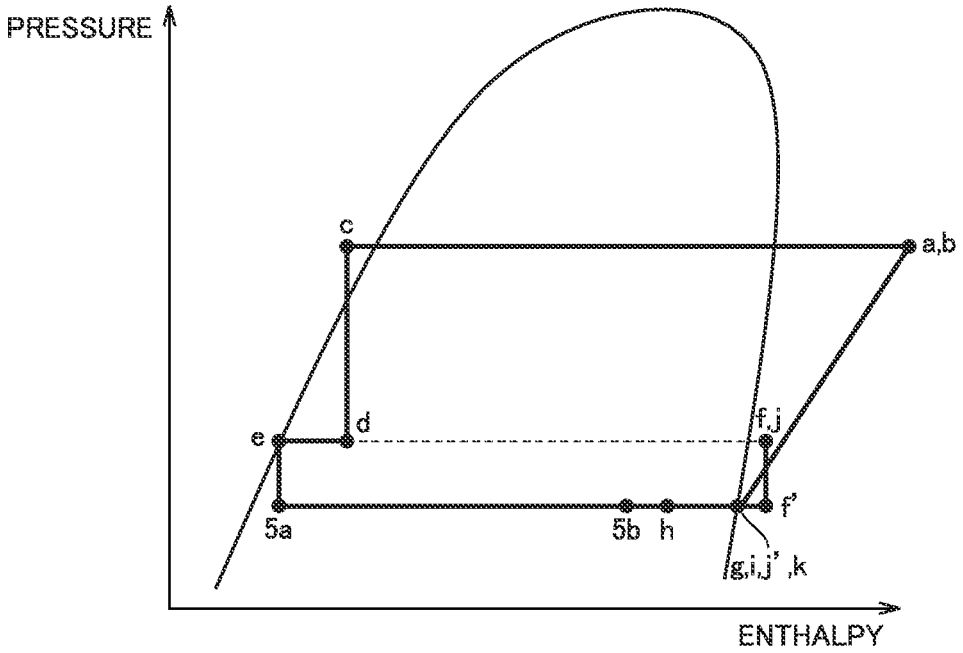
FIG. 21 is a p-h diagram showing a state change of the refrigerant in the first operation mode of refrigeration cycle apparatus 110D according to the fourth embodiment.

FIG. 21 is a p-h diagram showing a state change of the refrigerant in the first operation mode of refrigeration cycle apparatus 110D according to the fourth embodiment. Explanation will be made for FIG. 21 with reference to FIG. 19. By four-way valve 2, a point a and a point b in FIG. 19 communicate with each other. Further, by four-way valve 2 and second open/close valve V2, a point g and a point i in FIG. 19 communicate with each other. In the first operation mode, since bypass valve 11 is closed, the refrigerant circulates in the same path as that of refrigeration cycle apparatus 110C of the third embodiment. Therefore, FIG. 21 is the same as FIG. 17 illustrating the first operation mode of refrigeration cycle apparatus 110C according to the third embodiment, and therefore will not be described repeatedly.

Figure 22:
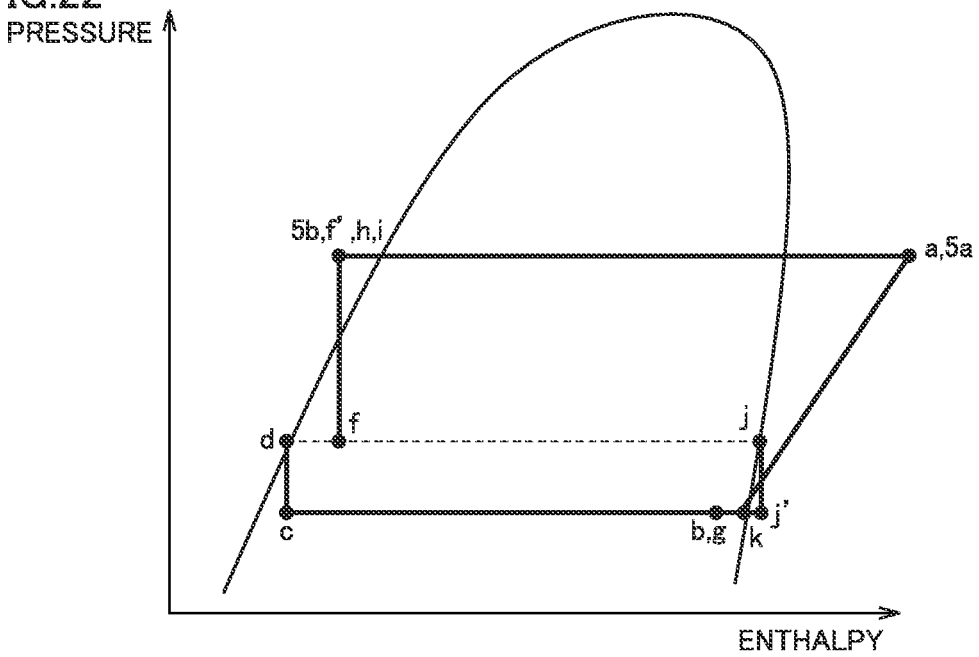
FIG. 22 is a p-h diagram showing a state change of the refrigerant in the second operation mode of refrigeration cycle apparatus 110D according to the fourth embodiment.

FIG. 22 is a p-h diagram showing a state change of the refrigerant in the second operation mode of refrigeration cycle apparatus 110D according to the fourth embodiment. Explanation will be made for FIG. 22 with reference to FIG. 20. By four-way valve 2 and third open/close valve V3, point a and a point 5*a* in FIG. 20 communicate with each other. Further, by four-way valve 2, point b and a point g in FIG. 20 communicate with each other. When bypass valve 11 is opened in this state, bypass valve 11 is connected between point j and point J', k, and acts as a decompressor.

The high-temperature and high-pressure gas refrigerant discharged from compressor 1 is condensed by second heat exchanger 5 as indicated by a line segment a, 5*a*-5*b, f', h, i*. Further, the refrigerant is decompressed in third decompressor 9 as indicated by a line segment 5*b, f', h, i-f* The refrigerant decompressed in third decompressor 9 flows into gas-liquid separator 6D, and part of the gas refrigerant is decompressed in bypass flow path 70 at the path of a line segment j-j'. The remainder of the refrigerant flows from port P1 of gas-liquid separator 6D to first decompressor 4, and is decompressed in first decompressor 4 as indicated by a line segment d-c. The liquid refrigerant decompressed in first decompressor 4 is evaporated in first heat exchanger 3 to become gas refrigerant as indicated by a line segments c-b, g.

Then, part of the gas refrigerant located at an intermediate pressure point j and having flowed out of gas-liquid separator 6 is decompressed by bypass valve 11 as indicated by j-j', is merged at a point k with the gas refrigerant at a point b, g, and is suctioned into compressor 1.

Figure 23:
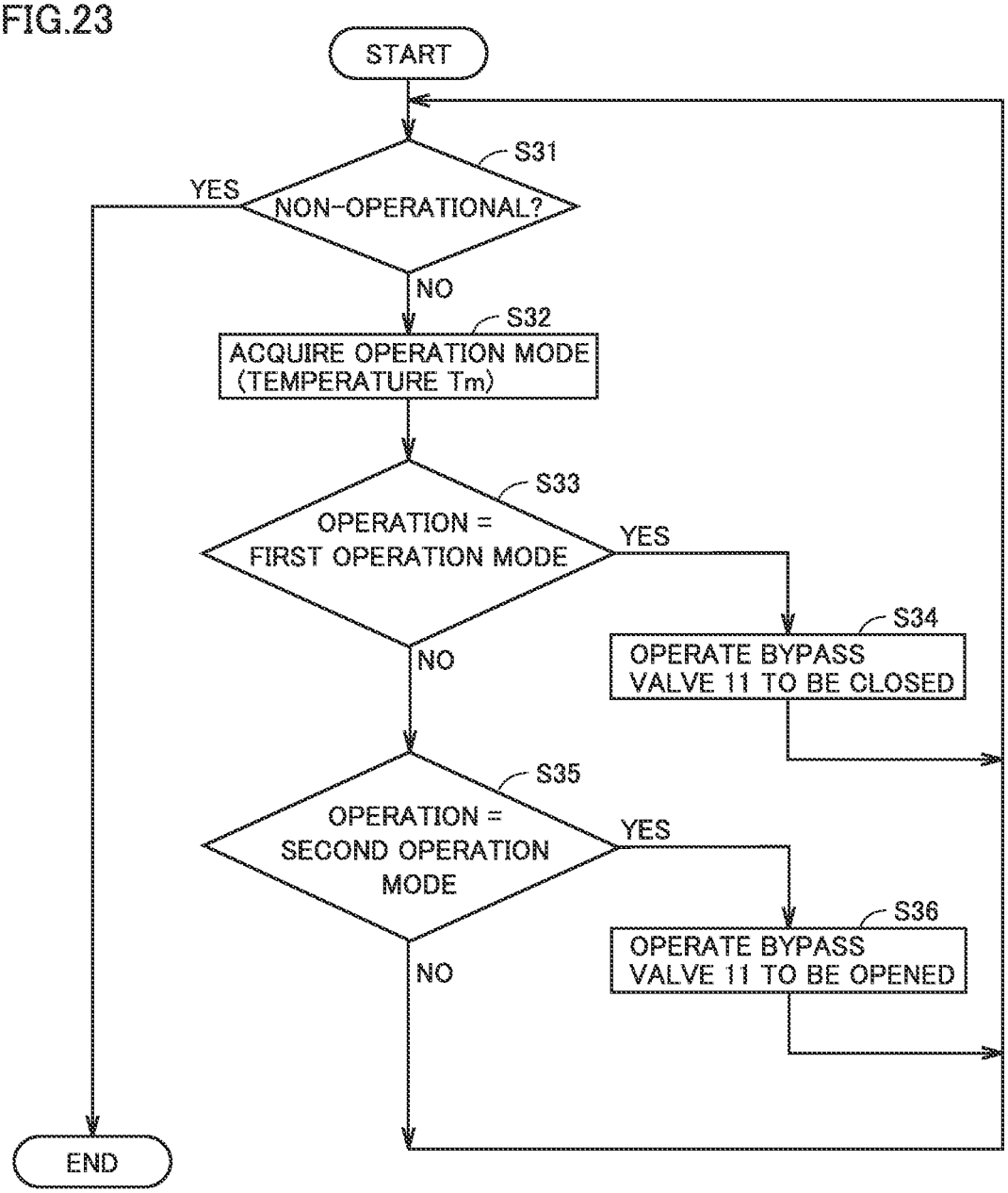
FIG. 23 is a flowchart for illustrating control of a bypass valve 11 in the fourth embodiment.

FIG. 23 is a flowchart for illustrating control of bypass valve 11 according to the fourth embodiment. When the process of this flowchart is started, in a step S31, controller 100D determines whether or not refrigeration cycle apparatus 110D is non-operational. When refrigeration cycle apparatus 110D is non-operational (YES in S31), the process is ended.

On the other hand, when refrigeration cycle apparatus 110D is operational (NO in S31), in a step S32, controller 100D acquires temperature Tm from sensor 51 to acquire the operation mode. For example, when temperature Tm is less than a determination value, the first operation mode can be acquired as the operation mode, whereas when temperature Tm is more than the determination value, the second operation mode can be acquired as the operation mode.

Then, in a step S33, controller 100D determines whether or not the operation mode is the first operation mode.

When the condition of step S33 is satisfied (YES in step S33), in a step S35, controller 100D operates bypass valve 11 to be closed.

When the condition of step S33 is not satisfied (NO in step S33), in step S35, controller 100D determines whether or not the operation mode is the second operation mode.

When the condition of step S35 is satisfied (YES in step S35), controller 100D operates bypass valve 11 to be opened in a step S36.

When the state of bypass valve 11 is determined in step S34 or S36, or when the operation mode is neither the first operation mode nor the second operation mode, controller 100D repeats the process from step S31 again.

According to refrigeration cycle apparatus 110D of the fourth embodiment described above, also in the second operation mode (high-pressure operation mode), part of the refrigerant to flow to first heat exchanger 3 and the tube is bypassed from gas-liquid separator 6D and returned to compressor 1, thereby reducing the pressure loss.

Further, also in the second operation mode (high-pressure operation mode), by lowering the degree of dryness at the inlet (c) of first heat exchanger 3 to attain a state close to the liquid state, the distribution of the refrigerant at the inlet (c) of first heat exchanger 3 can be made uniform.

CONCLUSION

The present embodiment is concluded as follows with reference to the figures again.

The present disclosure is directed to a refrigeration cycle apparatus. A refrigeration cycle apparatus 110 of FIG. 1 includes: a compressor 1; a first heat exchanger 3; a first decompressor 4; a gas-liquid separator 6; a second heat exchanger 5 having a first refrigerant port (5*a*) and a second refrigerant port (5*b*); a four-way valve 2 configured to change a flow path in accordance with a first operation mode and a second operation mode to switch, between a first order and a second order, an order of circulation of the refrigerant discharged from compressor 1; and a flow path switching apparatus 7. Flow path switching apparatus 7 is configured to switch a flow path to cause the refrigerant to flow into the first refrigerant port (5*a*) of second heat exchanger 5 and cause the refrigerant to flow out of the second refrigerant port (5*b*) of second heat exchanger 5, irrespective of whether the order is the first order or the second order.

The first order is an order of circulation of the refrigerant in the order of compressor 1, first heat exchanger 3, first decompressor 4, gas-liquid separator 6, and second heat exchanger 5. The second order is an order of circulation of the refrigerant in the order of compressor 1, second heat exchanger 5, gas-liquid separator 6, first decompressor 4, and first heat exchanger 3.

Gas-liquid separator 6 includes: a discharge port PD configured to discharge the refrigerant in a liquid state; a first port P1 connected to first decompressor 4; and a second port P2 into which the refrigerant flows and from which the refrigerant flows out.

Refrigeration cycle apparatus 110 further includes a second decompressor 8 connected between discharge port PD and the first refrigerant port (5*a*) of second heat exchanger 5. Flow path switching apparatus 7 is configured to, in the first operation mode, cause second port P2 and the second refrigerant port (5*b*) of second heat exchanger 5 to communicate with a suction port g of compressor 1 via four-way valve 2. Flow path switching apparatus 7 is configured to, in the second operation mode, cause second port P2 to communicate with the second refrigerant port (5*b*) of second heat exchanger 5 without second port P2 and the second refrigerant port (5*b*) of second heat exchanger 5 communicating with suction port g of compressor 1, and cause discharge port a of compressor 1 to communicate with the first refrigerant port (5*a*) of second heat exchanger 5 via four-way valve 2.

With such a configuration, in the first operation mode, heat exchange efficiency of the heat exchanger can be improved without deteriorating controllability for a flow rate of the flowing gas refrigerant.

Preferably, second heat exchanger 5 shown in FIGS. 2 and 3 includes: a first flow path 5*d* connected to the first refrigerant port (5*a*); a second flow path 5*e* disposed downstream with respect to first flow path 5*d* in the flow of the refrigerant and connected to first flow path 5*d* in series; and a fan 5*c* configured to generate a flow of air from second flow path 5*e* toward first flow path 5*d*. Since the flow path is switched by flow path switching apparatus 7 such that the refrigerant always flows into the first refrigerant port (5*a*) of second heat exchanger 5 and the refrigerant flows out of the second refrigerant port (5*b*) of second heat exchanger 5, the air and the refrigerant are in a relation of counter flows, with the result that heat exchange efficiency of second heat exchanger 5 can be excellent irrespective of the operation mode.

Preferably, flow path switching apparatus 7 shown in FIGS. 1 and 4 includes: a first open/close valve V1 configured to cause second port P2 to communicate with the second refrigerant port (5*b*) of second heat exchanger 5 in the first operation mode; a second open/close valve V2 configured to cause the second refrigerant port (5*b*) of second heat exchanger 5 to communicate with suction port g of compressor 1 via four-way valve 2 in the first operation mode shown in FIG. 1; and a third open/close valve V3 configured to cause the first refrigerant port (5*a*) of second heat exchanger 5 to communicate with discharge port a of compressor 1 via four-way valve 2 in the second operation mode shown in FIG. 4. With such a configuration, flow path switching apparatus 7 can be implemented.

Preferably, refrigeration cycle apparatus 110A shown in FIG. 7 further includes: a sensor 50-1 configured to detect a state of the refrigerant at the second refrigerant port (5*b*) of second heat exchanger 5 or a sensor 50-2 configured to detect the discharge temperature of compressor 1; and a controller 100A configured to control a degree of decompression of second decompressor 8. Controller 100A is configured to determine the degree of decompression to cause an output of sensor 50-1 or 50-2 to be close to a target value in the first operation mode.

Preferably, refrigeration cycle apparatus 110A shown in FIG. 8 further includes: a sensor 50-1 configured to detect a state of the refrigerant at the second refrigerant port (5*b*) of second heat exchanger 5 or a sensor 50-2 configured to detect a discharge temperature of compressor 1; and a controller 100A configured to control a degree of decompression of second decompressor 8. Controller 100A is configured to determine the degree of decompression to cause an output of sensor 50-1 or 50-2 to be close to a target value in the second operation mode.

Preferably, gas-liquid separator 6C shown in FIGS. 15 and 16 further includes: a housing 61 configured to store the refrigerant in a space communicating with discharge port PD, first port P1, and second port P2; a third port P3 and a fourth port P4; and a refrigerant path 10 configured to communicate third port P3 with fourth port P4. Refrigerant path 10 is configured to allow for heat exchange between the refrigerant stored in housing 61 and the refrigerant flowing through refrigerant path 10. Flow path switching apparatus 7C is configured to: in the first operation mode shown in FIG. 15, cause the second refrigerant port (5*b*) of second heat exchanger 5 to communicate with suction port g of compressor 1 via refrigerant path 10 and four-way valve 2; and in the second operation mode shown in FIG. 16, block the refrigerant flowing through refrigerant path 10.

With such a configuration, the state of the refrigerant at the outlet portion of second heat exchanger 5 can be a two-phase state in the first operation mode, thus resulting in improved heat transfer performance of second heat exchanger 5. Further, since the refrigerant suctioned to the compressor can be readily adjusted to a saturated state or a superheated state, heat insulating efficiency and volumetric efficiency of the compressor can be improved, thus resulting in increased reliability.

More preferably, gas-liquid separator 6C shown in FIGS. 19 and 20 further includes a fifth port P5 in which an end portion of a tube configured to suction the refrigerant inside housing 61 is provided at a position higher than first port P1 and second port P2. Refrigeration cycle apparatus 110D further includes: a bypass flow path 70 connecting between fifth port P5 and the suction port (k) of compressor 1; and a bypass valve 11 that is an open/close valve provided in bypass flow path 70.

More preferably, refrigeration cycle apparatus 110D further includes a controller 100D configured to control four-way valve 2 and bypass valve 11. Controller 100D is configured to close bypass valve 11 in the first operation mode shown in FIG. 19 and open bypass valve 11 in the second operation mode shown in FIG. 20.

With such a configuration, also in the second operation mode (high-pressure operation mode), part of the refrigerant to flow to first heat exchanger 3 and the tube is bypassed from gas-liquid separator 6D and is returned to compressor 1, thereby reducing pressure loss.

Further, also in the second operation mode (high-pressure operation mode), by lowering a degree of dryness at the inlet (c) of first heat exchanger 3 to attain a state close to the liquid state, the distribution of the refrigerant at the inlet (c) of first heat exchanger 3 can be made uniform.

The embodiments disclosed herein are illustrative and non-restrictive in any respect. The scope of the present disclosure is defined by the terms of the claims, rather than the embodiments described above, and is intended to include any modifications within the scope and meaning equivalent to the terms of the claims.

The invention claimed is:

1. A refrigeration cycle apparatus comprising:
- a compressor;
- a first heat exchanger;
- a first decompressor;
- a gas-liquid separator;
- a second heat exchanger having a first refrigerant port and a second refrigerant port;
- a four-way valve configured to change a flow path in accordance with a first operation mode and a second operation mode to switch, between a first order and a second order, an order of circulation of refrigerant discharged from the compressor; and
- a flow path switch configured to switch a flow path to cause the refrigerant to flow into the first refrigerant port of the second heat exchanger and cause the refrigerant to flow out of the second refrigerant port of the second heat exchanger, irrespective of whether the order is the first order or the second order,
- the first order being an order of circulation of the refrigerant in an order of the compressor, the first heat exchanger, the first decompressor, the gas-liquid separator and the second heat exchanger,
- the second order being an order of circulation of the refrigerant in an order of the compressor, the second heat exchanger, the gas-liquid separator, the first decompressor, and the first heat exchanger,
- the gas-liquid separator including
  - a discharge port configured to discharge the refrigerant in a liquid state,
  - a first port connected to the first decompressor, and
  - a second port into which the refrigerant flows and from which the refrigerant flows out,
- the refrigeration cycle apparatus further comprising a second decompressor connected between the discharge port and the first refrigerant port of the second heat exchanger,
- the flow path switch being configured to
  - in the first operation mode, cause the second port and the second refrigerant port of the second heat exchanger to communicate with a suction port of the compressor via the four- way valve, and
  - in the second operation mode, cause the second port to communicate with the second refrigerant port of the second heat exchanger without the second port and the second refrigerant port of the second heat exchanger communicating with the suction port of the compressor, and cause a discharge port of the compressor to communicate with the first refrigerant port of the second heat exchanger via the four-way valve.

2. The refrigeration cycle apparatus according to claim 1, wherein
- the second heat exchanger includes
  - a first flow path connected to the first refrigerant port,
  - a second flow path disposed downstream with respect to the first flow path and connected to the first flow path in series, and
  - a blower apparatus configured to generate a flow of air from the second flow path toward the first flow path.

3. The refrigeration cycle apparatus according to claim 1, wherein
- the flow path switch includes
  - a first open/close valve configured to cause the second port to communicate with the second refrigerant port of the second heat exchanger in the first operation mode,
  - a second open/close valve configured to cause the second refrigerant port of the second heat exchanger to communicate with the suction port of the compressor via the four-way valve in the first operation mode, and
  - a third open/close valve configured to cause the first refrigerant port of the second heat exchanger to communicate with the discharge port of the compressor via the four-way valve in the second operation mode.

4. The refrigeration cycle apparatus according to claim 1, further comprising:
- a sensor configured to detect a state of the refrigerant at the second refrigerant port of the second heat exchanger or a sensor configured to detect a discharge temperature of the compressor; and
- a controller configured to control a degree of decompression of the second decompressor, wherein
- the controller is configured to determine the degree of decompression to cause an output of the sensor to approach a target value in the first operation mode.

5. The refrigeration cycle apparatus according to claim 1, further comprising:
- a sensor configured to detect a state of the refrigerant at the second refrigerant port of the second heat exchanger or a sensor configured to detect a discharge temperature of the compressor; and a controller configured to control a degree of decompression of the second decompressor, wherein the controller is configured to determine the degree of decompression to cause an output of the sensor to approach a target value in the second operation mode.

6. The refrigeration cycle apparatus according to claim 1, wherein the gas-liquid separator further includes a housing configured to store the refrigerant in a space communicating with the discharge port, the first port, and the second port, a third port and a fourth port, and a refrigerant path configured to communicate the third port with the fourth port, the refrigerant path is configured to allow for heat exchange between the refrigerant stored in the housing and the refrigerant flowing through the refrigerant path, and the flow path switch is configured to in the first operation mode, cause the second refrigerant port of the second heat exchanger to communicate with the suction port of the compressor via the refrigerant path and the four-way valve, and in the second operation mode, block the refrigerant flowing through the refrigerant path.

7. The refrigeration cycle apparatus according to claim 6, wherein the gas-liquid separator further includes a fifth port in which an end portion of a tube configured to suction the refrigerant inside the housing is provided at a position higher than the first port and the second port, the refrigeration cycle apparatus further comprising:

a bypass flow path connecting between the fifth port and the suction port of the compressor; and an open/close valve provided in the bypass flow path.

8. The refrigeration cycle apparatus according to claim 7, further comprising a controller configured to control the four-way valve and the open/close valve, wherein the controller is configured to close the open/close valve in the first operation mode and open the open/close valve in the second operation mode.

* * * * *